United States Patent [19]

Shibusawa et al.

[11] Patent Number: 5,060,922

[45] Date of Patent: Oct. 29, 1991

[54] COPYING PAPER PROCESSING APPARATUS

[75] Inventors: Mitsuo Shibusawa; Tsutomu Yamakami, both of Yokohama; Atsushi Arai, Ichikawa; Hiroshi Kawano, Tokyo, all of Japan

[73] Assignee: Ricoh Company, Ltd., Tokyo, Japan

[21] Appl. No.: 379,006

[22] Filed: Jul. 12, 1989

[30] Foreign Application Priority Data

Jul. 13, 1988 [JP] Japan ..... 63-172547

[51] Int. Cl.[5] ..... B42B 1/02

[52] U.S. Cl. ..... 270/53; 270/58

[58] Field of Search ..... 270/53, 37, 58; 355/322, 323, 324

[56] References Cited

U.S. PATENT DOCUMENTS

| | | | |
|---|---|---|---|
| 4,801,133 | 1/1989 | Ishiguro | 270/53 |
| 4,901,994 | 2/1990 | Ishiguro | 270/53 |
| 4,917,366 | 4/1990 | Murakami | 270/53 |

FOREIGN PATENT DOCUMENTS

| | | | |
|---|---|---|---|
| 3724992 | 2/1988 | Fed. Rep. of Germany . | |
| 62-269852 | 11/1987 | Japan . | |
| 63-123763 | 5/1988 | Japan | 270/53 |
| 63-165268 | 7/1988 | Japan | 270/53 |
| 63-165269 | 7/1988 | Japan | 270/53 |

*Primary Examiner*—Edward K. Look
*Assistant Examiner*—Theresa M. Newholm
*Attorney, Agent, or Firm*—Oblon, Spivak, McClelland, Maier & Neustadt

[57] ABSTRACT

A copying paper processing apparatus comprises a sorter, a stapling device for stapling sheets of copying paper sorted by the sorter, and a device for automatically selecting and setting a sort mode when a staple mode is selected and set. The processing apparatus may comprise a switch for selecting the stapling operation, and a device for automatically selecting and setting a staple mode when the staple selecting switch is turned on and a sort mode is selectively set. The processing apparatus may comprise a device for transmitting a signal indicating that there is no staple needle when the number of staple needles left in the stapling device is a predetermined number greater than the total number of bins of the sorter. The processing apparatus may comprise a device for inhibiting the operation of the stapling device when one of sensors respectively disposed in a paper-receiving base of the stapling device and a sorter bin of the sorter detects that there is no paper.

9 Claims, 32 Drawing Sheets

| Fig. 21 (i) | Fig. 21 (ii) |
|---|---|

Fig.21 (ii)
| Fig.21 (i) | Fig.21 (ii) |
|---|---|
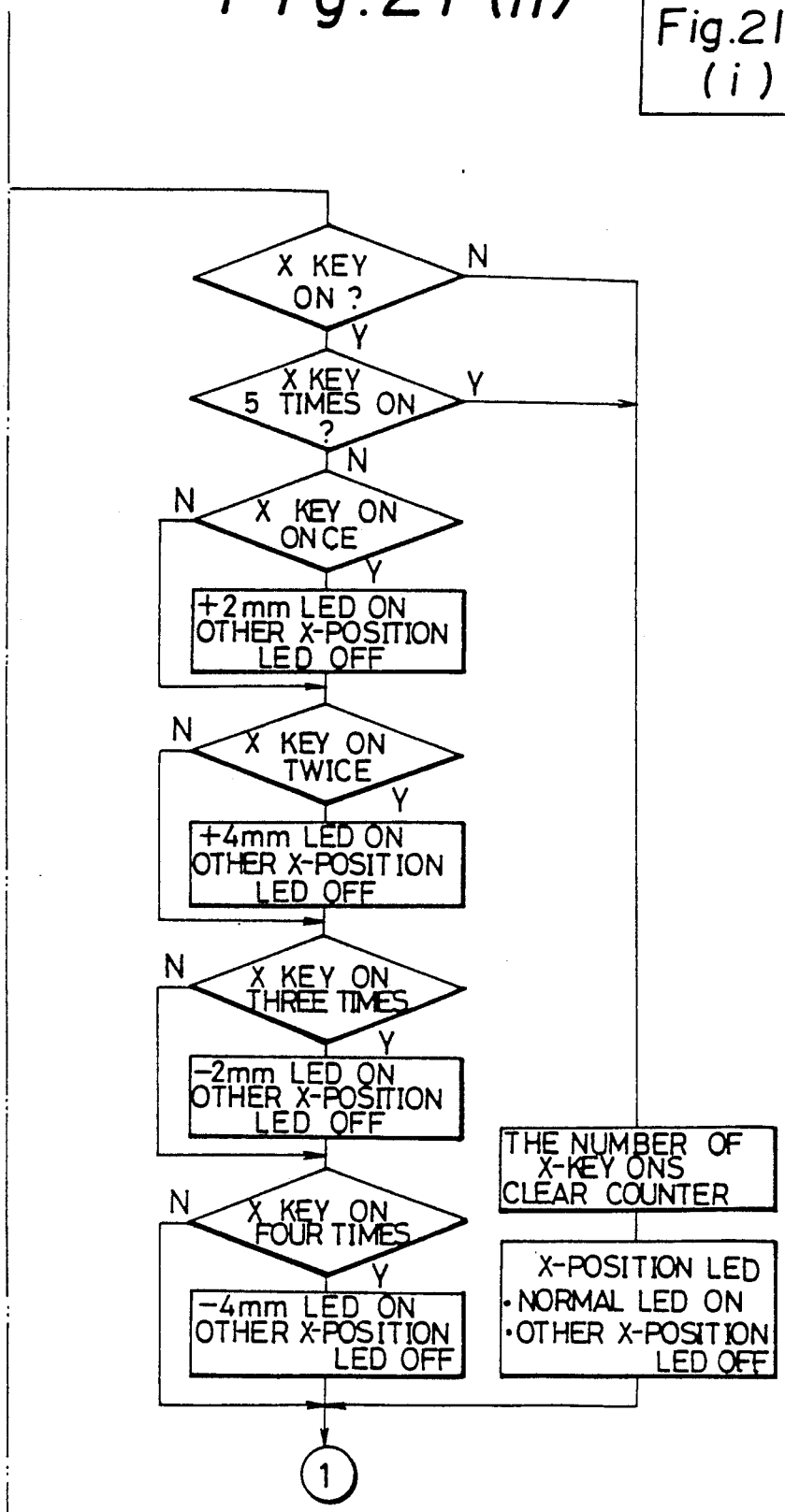

| Fig.22 (i) |
|---|
| Fig.22 (ii) |

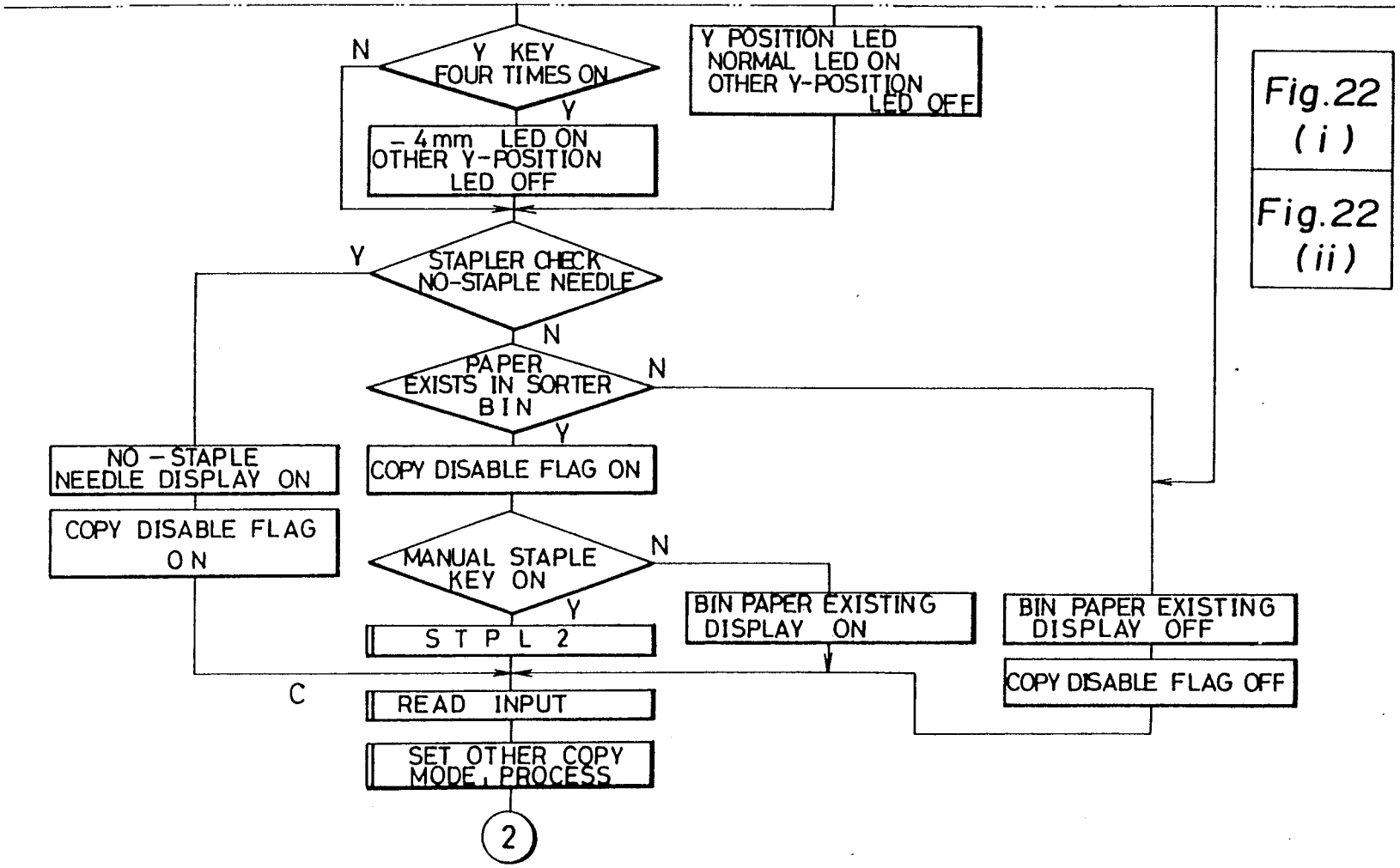
Fig. 22 (ii)

Fig. 23 (ii)
2
COPY DISABLE FLAG ON ?
Y
N
PRINT DISABLE DISPLAY ON
PRINT ENABLE DISPLAY OFF
PRINT ENABLE DISPLAY ON
PRINT DISABLE DISPLAY OFF
PRINT KEY ON ?
N
Y
B
PRINT ENABLE DISPLAY OFF
(S20)
ADF MANUSCRIPT SET SENSOR ON ?
Y
N
MANUSCRIPT FEED ON
MANUSCRIPT FEED COMPLETED ?
Y
N
RELEASE STAPLE MODE
STAPLE LED OFF
RELEASE SORT MODE
SORT LED OFF
SELECT SORT MODE ?
Y
N

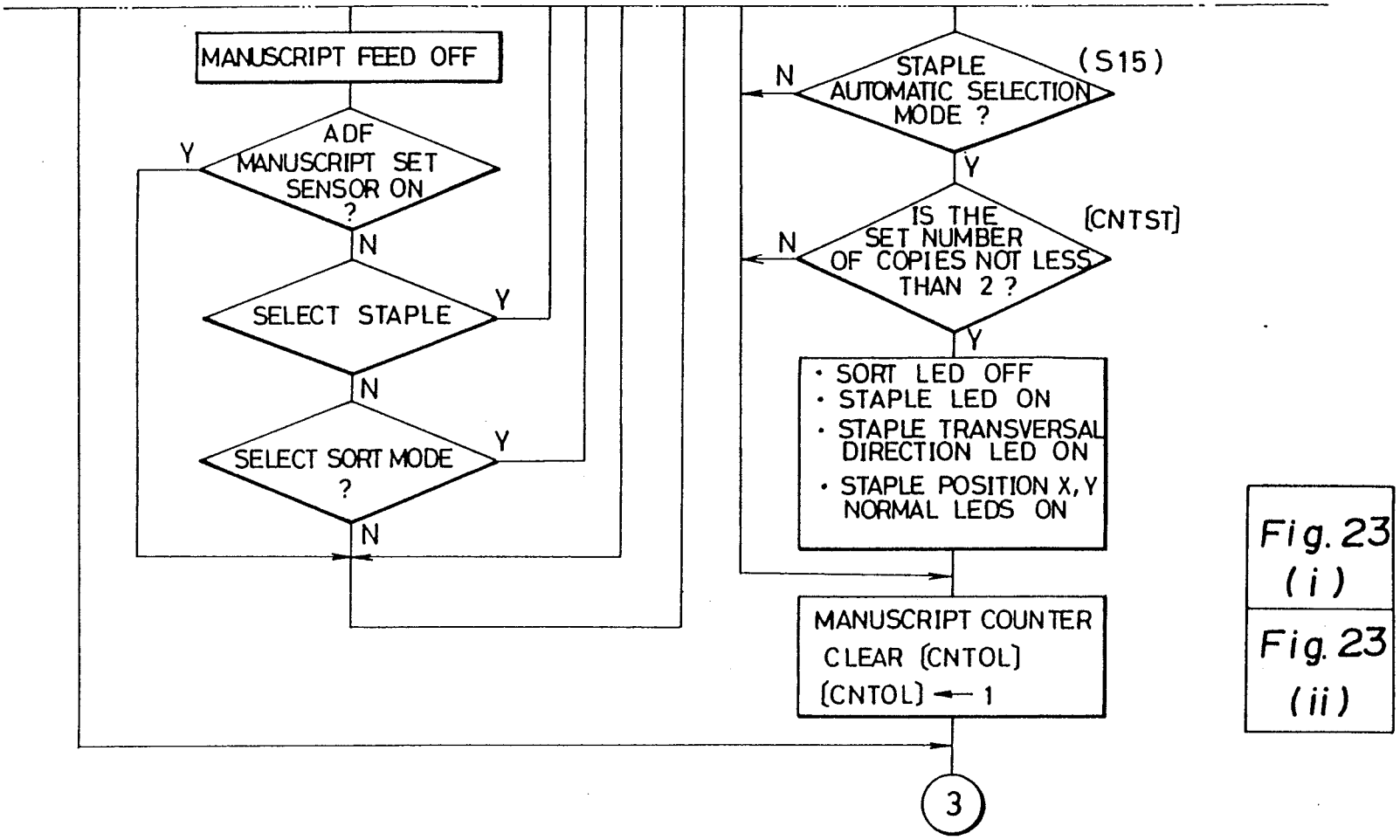
Fig. 23 (ii)

| Fig.24 (i) |
| --- |
| Fig.24 (ii) |

Fig. 24 (ii)
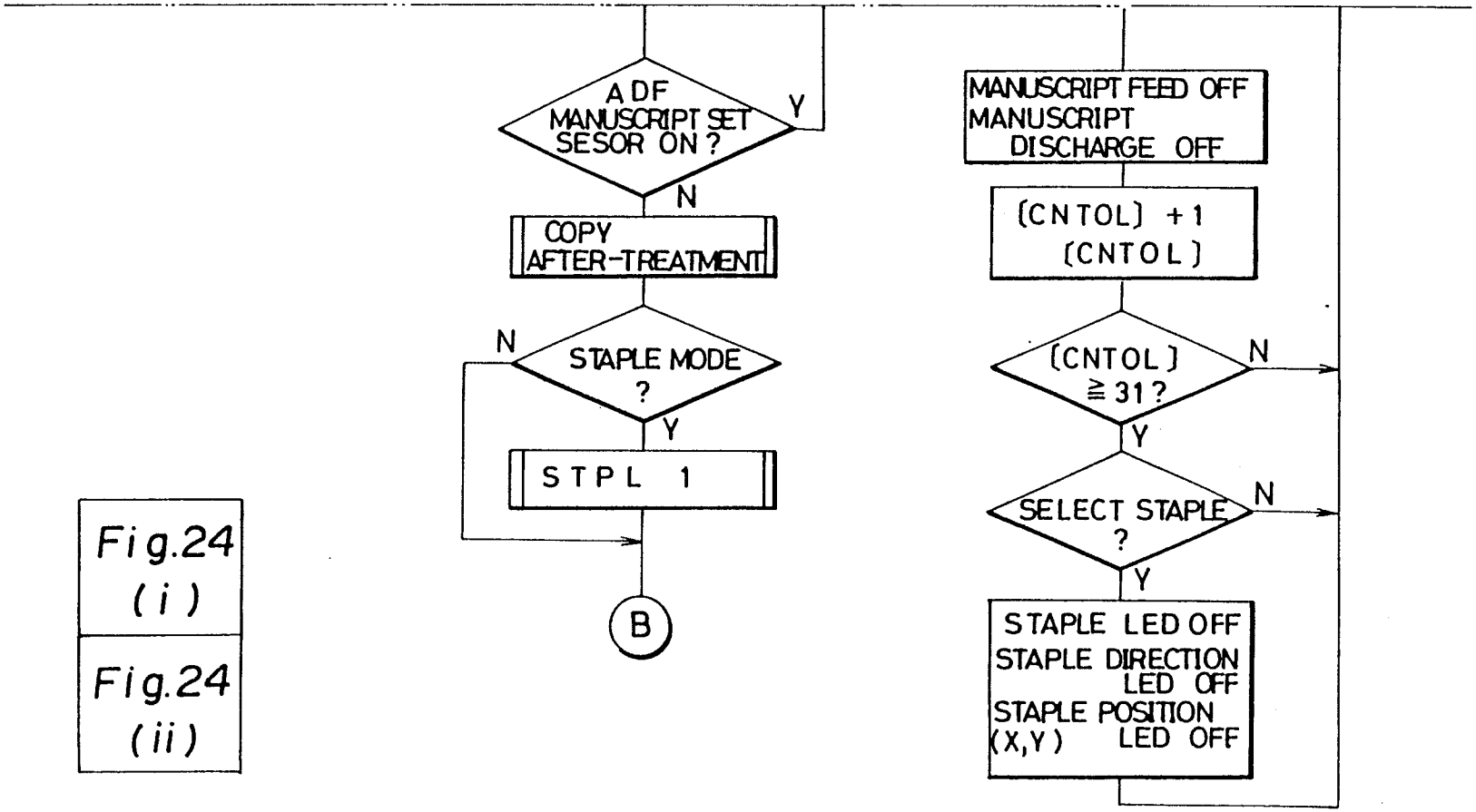
| Fig.24 (i) |
|---|
| Fig.24 (ii) |

COPYING PAPER PROCESSING APPARATUS

BACKGROUND OF THE INVENTION

The present invention relates to a copying paper processing apparatus having therein a sorter and a stapling device for stapling sorted sheets of copying paper together.

As is well known, a feeder for automatically supplying a manuscript and a sorter are additionally disposed to improve the efficiency in office work with respect to a copying machine so as to automatically sort a plurality of sets of copying paper.

Recently, an apparatus for processing the copying paper has been proposed. In this copying paper processing apparatus, a stapling device is further attached to the copying machine provided with the sorter such that it is possible to staple the plural sorted sheets of copying paper together. Further, a device for making holes for stapling the copying paper by a combination of the automatic manuscript feeder and a finisher has been also proposed. The efficiency in office work in the copying paper processing apparatus has been greatly improved by disposing the sorting and stapling functions in this apparatus. However, an operator sometimes makes a mistake with respect to the operation of the processing apparatus. Namely, the operator sometimes sets a staple mode instead of selecting and setting a sorter mode so that the stapling processing is sometimes performed in a state in which the sorting processing is not correctly performed. Accordingly, it is necessary to sort and staple the plural sheets of copying paper again, thereby reducing the productivity.

When the copying machine is operated in a state in which some sheets of paper are left in bins of the sorter and the sorting and stapling operations are then performed, some sheets of unnecessary paper are stapled together so that it takes time to perform the abovementioned operations again.

Further, when the sheets of copying paper are stapled by the stapling device, there is a case in which the staple mode is not selected and set in error and the copying operation begins to be performed by setting only the sorter mode. Accordingly, in such a case, it is necessary to manually re-staple the sorted copying paper later so that the productivity is reduced.

In another conventional copying paper processing apparatus, the stapling operation is interrupted when the sheets of copying paper sorted and stored within the plurality of sorter bins are stapled by operating the stapling device and the stapling device runs out of staple needle during the stapling operation. Further, the copying operation is also interrupted when it is detected that the stapling device runs out of staple needle while the sorting operation has been completed with respect to a first sorter bin and the copying and sorting operations are continuously performed with respect to the subsequent sorter bin and the stapling operation is sequentially performed with respect to the sorted sheets of paper in the sorter bin. Accordingly, when the stapling device runs out of staple needle, the productivity is reduced since the operation of the copying paper processing apparatus is interrupted.

Further, in the conventional apparatus, the stapling operation is continuously performed in a state in which the stapling device runs out of staple needle, thereby performing the stapling operation without staple needle in a certain case. In such a case, the operator takes the unsorted sheets of copying paper out of the processing apparatus although the operator thinks that the sheets of copying paper have been already sorted, and the productivity is also reduced.

In addition, there is a case in which the stapling device is operated and performs the stapling operation in a state in which there is no paper, thereby uselessly consuming the staple needles and damaging some constructional portions of the processing apparatus.

SUMMARY OF THE INVENTION

It is therefore a first object of the present invention to provide a copying paper processing apparatus for performing the stapling operation by a stapling device only in a state in which the copying paper is correctly sorted at any time.

A second object of the present invention is to provide a copying paper processing apparatus for reliably performing the stapling operation by the stapling device at any time after the copying paper is sorted.

A third object of the present invention is to provide a copying paper processing apparatus for preventing staple needle from running out before the stapling operation has been completely performed with respect to sheets of copying paper sorted by a sorter.

A fourth object of the present invention is to provide a copying paper processing apparatus for preventing the stapling operation from being performed in a state in which there is no paper.

The first object of the present invention can be achieved by a copying paper processing apparatus comprising a sorter; a stapling device for stapling sheets of copying paper sorted by the sorter; and a device for automatically selecting and setting a sort mode when a staple mode is selected and set.

In accordance with the above construction of the present invention for attaining the first object, the staple mode for operating the stapling device is set in a state in which the sort mode is set and the sheets of copied paper are sorted. The stapling device is not operated when the sheets of copied paper is not correctly sorted. When there is an unnecessary sheet of paper in the sorter, the staple mode is not set and thereby the unnecessary sheet of paper is not stapled.

The second object of the present invention can be achieved by a copying paper processing apparatus comprising a sorter; a stapling device for stapling sheets of copying paper sorted by the sorter; a switch for selecting the stapling operation; and a device for automatically selecting and setting a staple mode when the staple selecting switch is turned on and a sort mode is selectively set.

In accordance with the above construction of the present invention for attaining the second object, in many cases in which the sorted sheets of coping paper are stapled by the stapling device, the staple selecting switch disposed in the sorter is set to be turned on so that the sorted sheets of copying paper are automatically stapled when it is necessary to perform the sorting operation even when an operator forgets to push a staple key. Accordingly, it is not necessary to perform the stapling operation again later so that the efficiency in office work is improved.

The third object of the present invention can be achieved by a copying paper processing apparatus comprising a sorter; a stapling device for stapling sheets of copying paper sorted by the sorter; and a device for transmitting a signal indicating that there is not staple needle when the number of staple needles left in the stapling device is a predetermined number greater than the total number of bins of the sorter.

In accordance with the above construction of the present invention for attaining the third object, the signal indicating that there is no staple needle is transmitted when the number of staple needles left in the sorter bins is reduced to the predetermined number greater than the total number of bins in the sorter, thereby displaying that it is necessary for the operator to supplement staple needles. Accordingly, all the sheets of copying paper in the sorter bins can be reliably stapled until the signal indicating that there is no staple needle is transmitted. There is no case in which the stapling operation can be performed with respect to the sheets of copying paper until the midway bins, but cannot be performed with respect to the remaining sheets of copying paper for lack of staple needle.

The processing apparatus is controlled so as not to transmit the no-staple needle signal even when the number of staple needles left in the sorter bins has reached the predetermined number while the stapling device begins to be operated. Accordingly, there is no case in which the stapling operation is interrupted to supplement the staple needles since the stapling device runs out of staple needle during the stapling operation. The stapling operation is not interrupted since all the sheets of copying paper in the sorter bins can be stapled at least once after the no-staple needle signal is transmitted so that the stapling device has a sufficient number of staple needles for performing the stapling operation with respect to the sheets of copying paper left in the sorter bins even when it is detected that there is no staple needle in the stapling device while the stapling operation is started once and performed. In accordance with this construction, the stapling device is prevented from performing the stapling operation with no staple needle.

The fourth object of the present invention can be achieved by a copying paper processing apparatus comprising a sorter; a stapling device for stapling sheets of copying paper sorted by the sorter; and a device for inhibiting the operation of the stapling device when one of sensors respectively disposed in a paper-receiving base of the stapling device and a sorter bin of the sorter detects that there is no paper.

In accordance with the above construction of the present invention for attaining the fourth object, the stapling device is controlled not to be operated when the sensor detects that there is no paper in the sorter bin relating to the stapling operation by the stapling device or that there is no paper on the paper-receiving base of the stapling device even when there is paper in the sorter bin.

Further objects and advantages of the present invention will be apparent from the following description of the preferred embodiments of the present invention as illustrated in the accompanying drawings.

DESCRIPTION OF THE PREFERRED EMBODIMENTS

The preferred embodiment of a copying paper processing apparatus in accordance with the present invention will now be described in detail with reference to the accompanying drawings.

Figure 1:
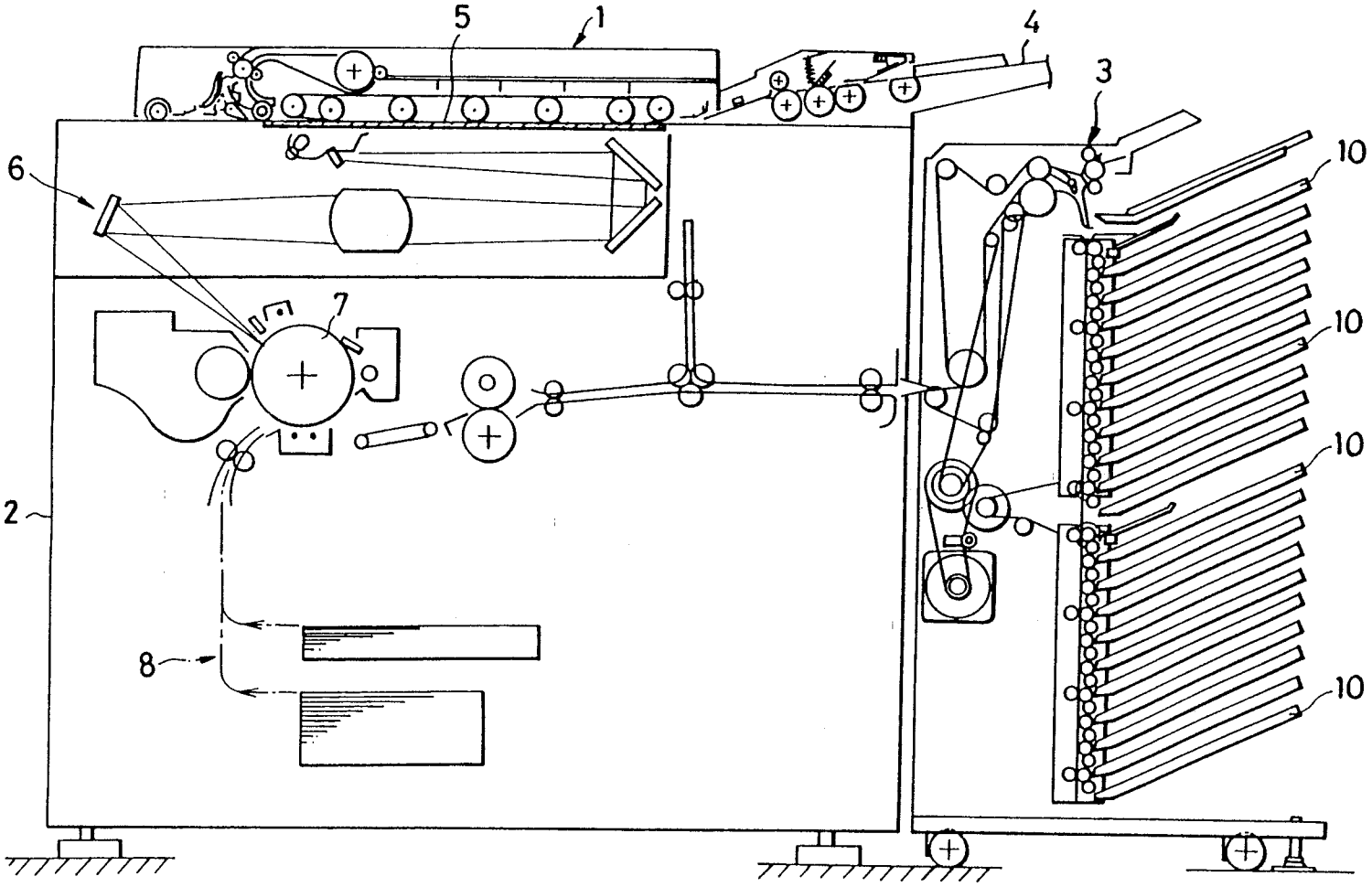
FIG. 1 is a view schematically showing the entire copying machine to which a copying paper processing apparatus in accordance with the present invention is applied.

An apparatus applying the present invention thereto comprises sorter 3 additionally attached to copying machine body 1 provided with an automatic manuscript feeder(ADF) as shown in FIG. 1 for example.

A manuscript is arranged according to page numbers and is set a downward-looking direction on set table 4 of the automatic manuscript feeder (ADF). When an operator sets the required number of copies and then pushes a print button, the manuscript on a first page is sent to a predetermined position of contact glass 5. Then, an image is formed on photosensitive element 7 by the reading operation of optical system 6 and is transferred onto a sheet of paper to be copied fed from paper feeder 8. Thereafter, the copied paper is inverted on conveying line 9 and the image face is directed downwards and the copied paper is sequentially discharged onto respective bins 10 of sorter 3 from the top thereof. Next, the manuscripts on a second page and the subsequent page are repeatedly discharged similarly.

After the copying operation of all the manuscripts has been completed, the respective sheets of copying paper are sequentially arranged according to the page numbers and are stored into the bins corresponding to the first set number of copies, thereby completing the sorting operation.

Figure 2:
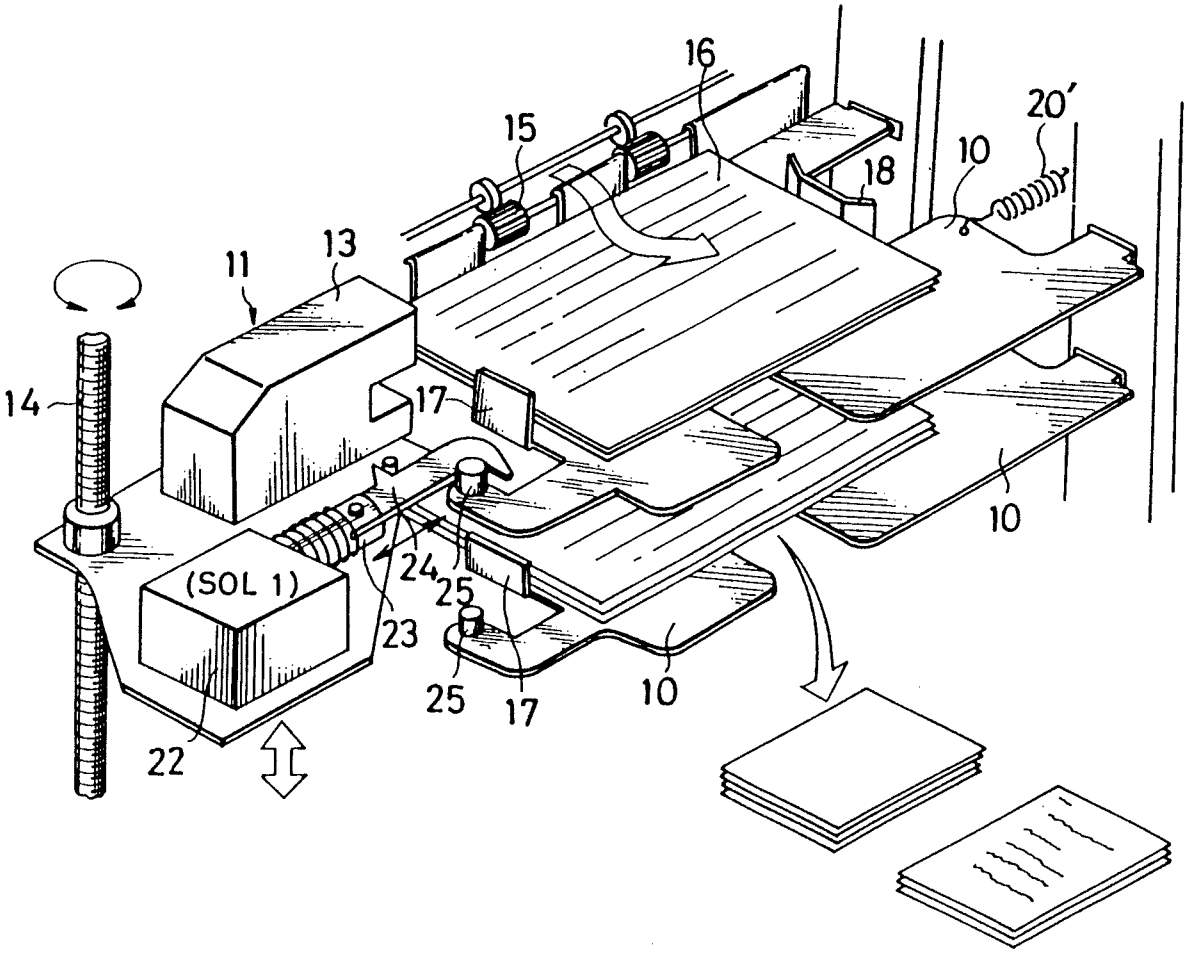
FIG. 2 is a partially perspective view showing the relation between bins of a sorter and a stapling device.

As shown in FIG. 2 for example, stapling device 11 is disposed in sorter 3. Stapling device 11 has stapler 13 set in base 12 moved upwards and downwards so as to stop in positions of respective bins 10. Base 12 is moved upwards and downwards by drive screw shaft 14 for example.

Respective bins 10 can be formed as a tray for arranging thereon copying paper 16 fed by feed roller 15. Tray 10 has stopper 17 disposed on an end face thereof on the side of stapler 13 and pressure plate 18 for pressing copying paper 16 against stopper 17 to properly arrange the sheets of copying paper.

Tray 10 is formed to be movable so as to send the copying paper to receiving base 19 of stapler 13 in a state in which copying paper 16 is disposed on tray 10. Tray 10 is normally held by spring 20' in a stand-by position.

Figure 3:
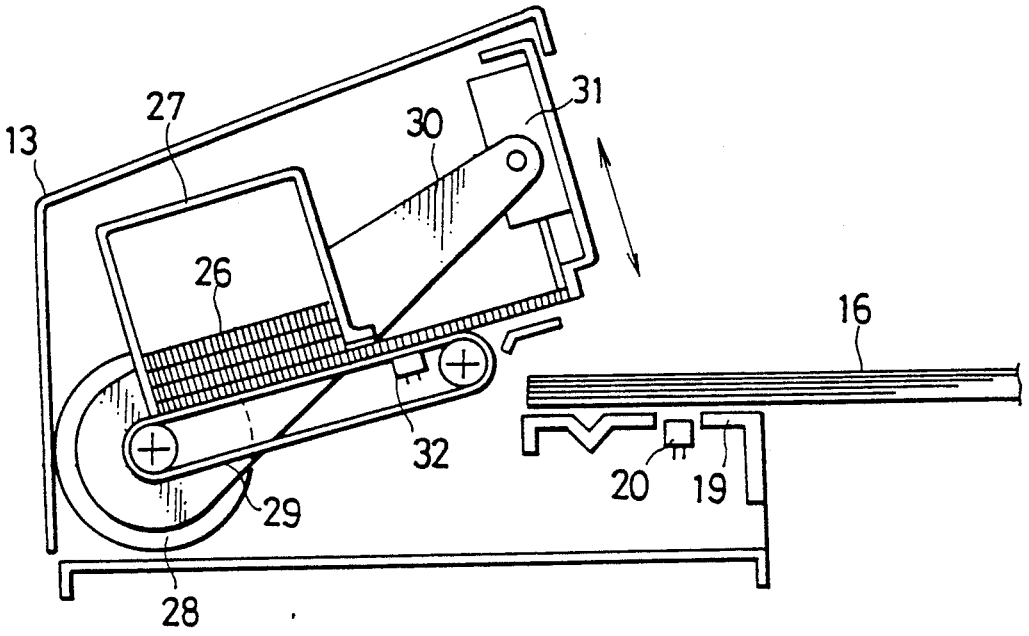
FIG. 3 is a cross-sectional view of a stapler.

As shown in FIGS. 2 and 3, stapling device 11 has stapler 13 and tension device 21 for tensioning tray 10 to set copying paper 16 to a predetermined position of receiving base 19 of stapler 13. Tension device 21 is arranged on base 12 and is moved upwards and downwards together with stapler 13. Tension device 21 has solenoid 22 and hook 24 fixed to plunger 23 of solenoid 22. Hook 24 is formed so as to be engaged with drawing pin 25 fixed to tray 10.

When solenoid 22 is energized, hook 24 is drawn in and drawing pin 25 is pulled so that tray 10 is pulled in the longitudinal direction of stapler 13 against the resilient force of spring 20'. At this time, a corner of copying paper 16 is moved onto receiving base 19 of stapler 13.

Stapler paper detecting sensor(S13) 20 is disposed in receiving base 19 and detects whether there is a sheet of paper on receiving base 19 or not.

When solenoid 22 is de-energized, tray 10 is retracted by the spring force so that copying paper 16 is separated from stapler 13.

Stapler 13 is formed to detachably dispose staple needle cartridge 27 in which a number of staple needles 26 are housed. The staple needles in staple needle cartridge 27 are sent by feed belt 29 driven by drive motor 28. Arm 30 is pivoted or swung upwards and downwards by drive motor 28 so that head 31 is moved upwards and downwards to hit staple needles 26 against receiving base 19. Thus, the sheets of copying paper 16 are stapled by the staple needles like a Hotchkiss.

Staple needle end sensor(S12) 32 is disposed in positions of a predetermined number of staple needles from a hitting-in position by head 31 and detects whether there is a staple needle or not. The predetermined number of staple needles is set to a number greater than 40, e.g., from 70 to 100 in consideration of the number of pins, e.g., 20 pins, and the number of stapling positions of one document, e.g., two stapling positions at its maximum.

Stapler 13 first staples the copying paper in the top bin. Then, base 12 is lowered by an amount of one bin and tray 10 is drawn by the operation of solenoid 22. Then, the copying paper is stapled by stapler 13 and the solenoid is de-energized and tray 10 is returned to its original position and the next bin is lowered. Such operations are repeatedly performed. A sensor, a controller for controlling the operation of the drive screw shaft, etc. are disposed to stop base 12 in a predetermined position every bin.

Figure 4:
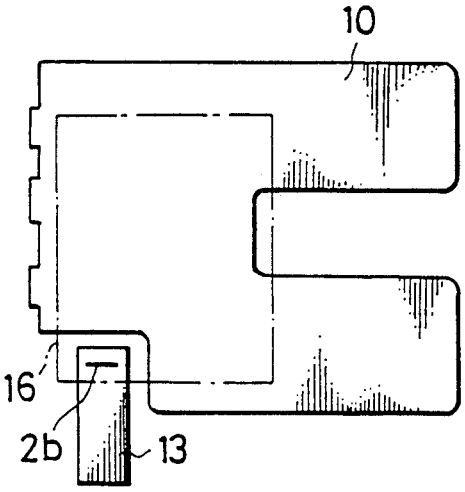
FIG. 4 is a plan view showing the relation between the bins, the stapler and the copying paper.
Figure 5:
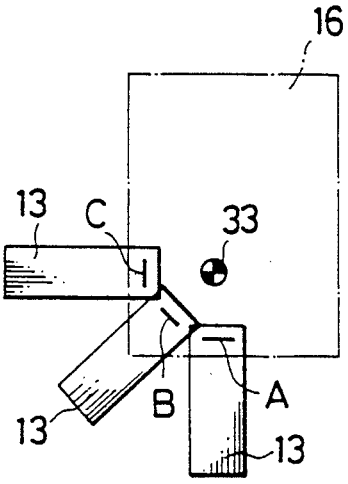
FIG. 5 is a plan view showing the change in arranging direction of the stapler.

As shown in FIG. 4, stapler 13 is arranged to staple the copying paper by staple needles 26 in a predetermined position of a corner portion of the copying paper on bin 10. First stapling position A is provided when the copying paper long in the longitudinal direction is stapled by staple needles 26 in the transversally extending direction, as shown in FIG. 4. As shown in FIG. 5, the stapling position can be switched to perform the stapling operation from second stapling position(slanting position) B in which the staple needles are inclined by about 45° with respect to first stapling position(transversal position) A to third stapling position(longitudinal position) C in which the staple needles are inclined by 90° with respect to the first stapling position and extend in the longitudinal direction. In this case, stapler 13 is rotated around central axis 33 and the angle position thereof can be switched every 45°. The switching positions of the stapler are not limited to these three positions, but the stapler can be switched to an arbitrary angle position.

Figure 6:
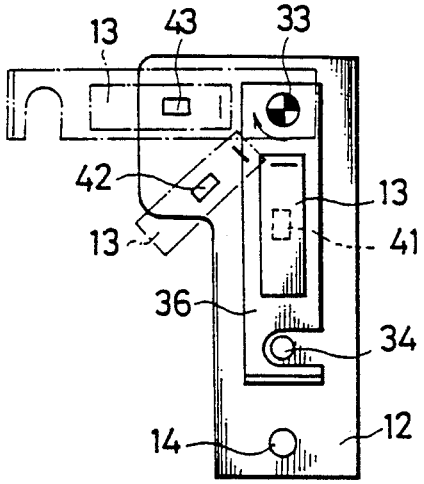
FIG. 6 is a plan view showing an automatically direction converting means of the stapler.
Figure 7:
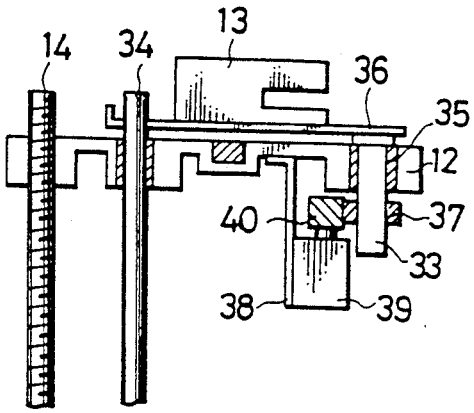
FIG. 7 is a side view of the copying machine of FIG. 1.

As shown in FIGS. 6 and 7, to adjust the arranging direction of stapler 13, auxiliary base 36 is fixed to central shaft 33 rotatably supported through bearing 35 by base 12 movable upwards and downwards by drive screw shaft 14 and guide shaft 34. Stapler 13 is fixed to this auxiliary base 36.

Gear 37 is fixed to central shaft 33 and is engaged with drive gear 40 attached to motor(M3) 39 supported by base 12 through bracket 38, thereby rotating gear 37. For example, transversal position sensor(S4) 41 for the first stapling(transversal) position, slanting position sensor(S6) 42 for the second stapling(slanting) position, and longitudinal position sensor(S5) 43 for the thrid stapling(longitudinal) position are disposed in base 12 in switching positions set in advance. When it is detected that stapler 13 is moved to a predetermined position, the operation of motor(M3) 39 is stopped and the arranging direction of stapler 13 is controlled.

Figure 8:
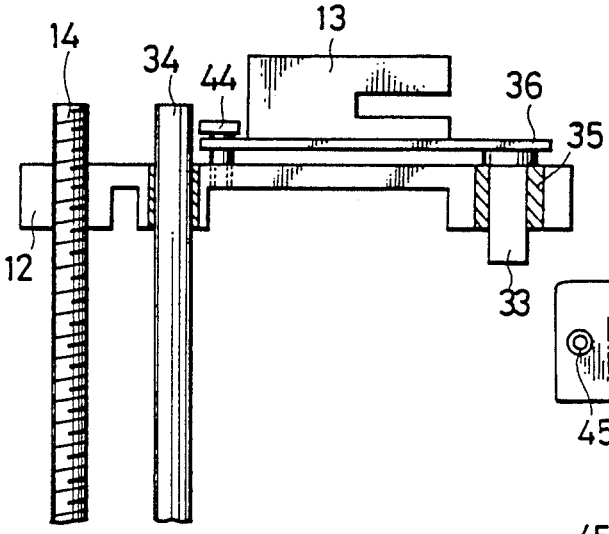
FIG. 8 is a side view showing a manually direction-converting means of the stapler.
Figure 9:
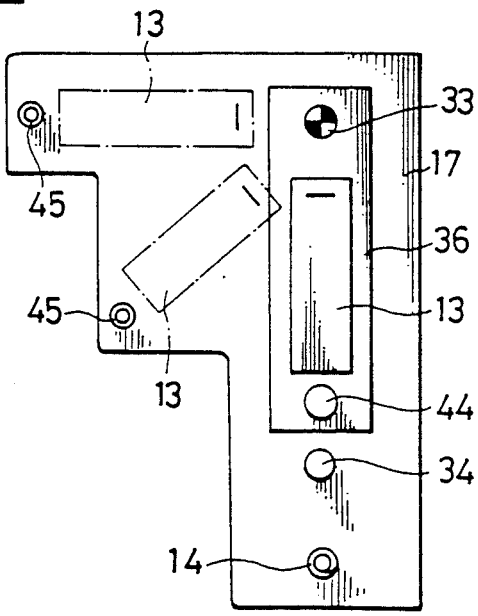
FIG. 9 is a plan view of the stapler of FIG. 8.

In FIGS. 6 and 7, the arranging direction of stapler 13 is automatically controlled. However, as shown in FIGS. 8 and 9, the arranging direction of stapler 13 can be constructed to be manually controlled. In this case, instead of gear 37, motor 39 and drive gear 40 in the embodiment shown in FIG. 7, thumbscrew 44 is rotatably attached to auxiliary base 36 or is attached to auxiliary base 36 such that thumbscrew 44 can be screwed into this auxiliary base, and thumbscrew 44 is screwed into screw hole 45 in a predetermined position of base 12 or is fixed to base 12 in position such that thumbscrew 44 is pressed against this base 12. When the arranging direction of the stapler is switched, thumbscrew 44 is unfastened and auxiliary base 36 is then moved to a predetermined position and thereafter thumbscrew 44 is tightened and fixed again. In this example, a user can easily change the arranging direction of stapler 13. A lever can be used instead of thumbscrew 44 and the number of switching positions can be arbitrarily selected.

Figure 10:
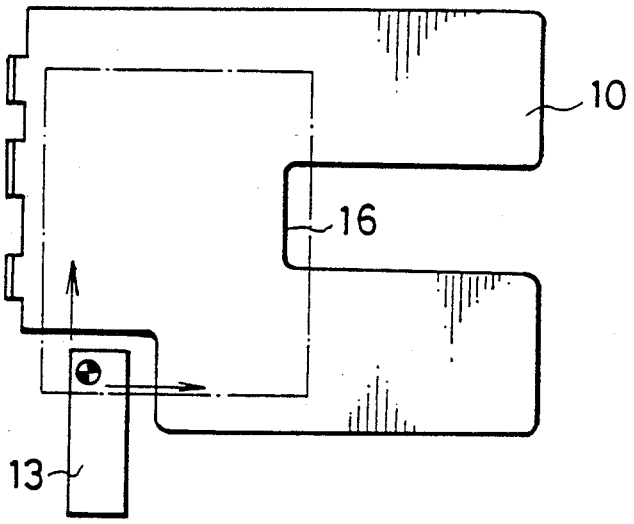
FIG. 10 is a plan view for explaining the adjustment of the position of the stapler.
Figure 11:
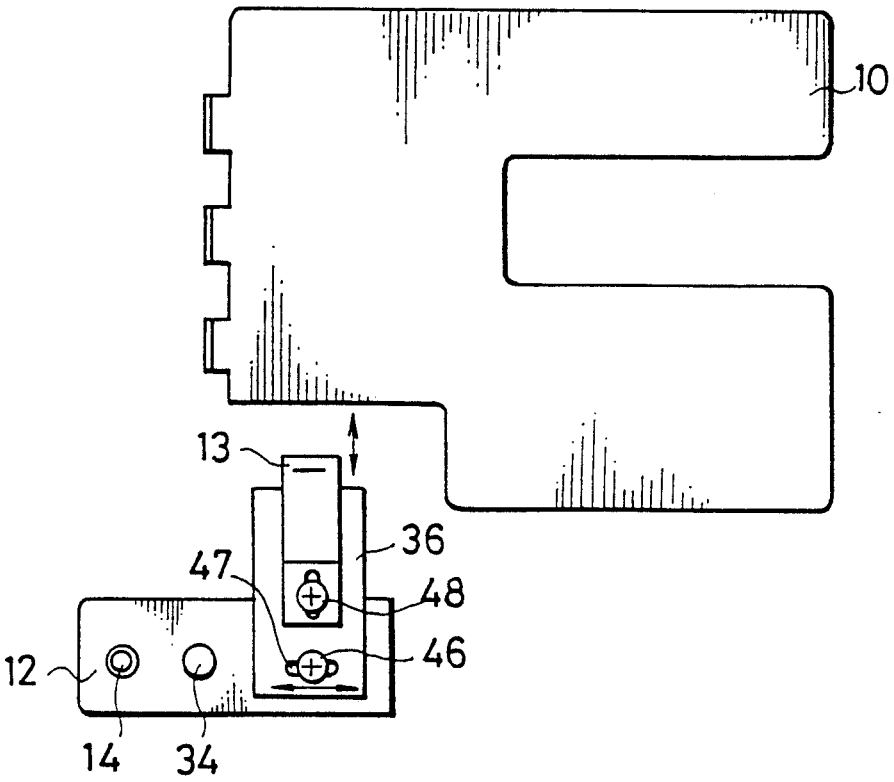
FIG. 11 is a plan view showing a means for adjusting the manual position of the stapler.

The arranging direction of stapler 13 with respect to the copying paper can be adjusted as mentioned above. In addition to this adjustment, as shown in FIG. 10, when the feeding direction of the copying paper by feed roller 15 is the X direction, the position of the stapler can be adjusted in the X direction and the Y direction perpendicular to the X direction. To adjust the position of the stapler in these directions, as shown in FIG. 11, auxiliary base 36 or an auxiliary bracket for enabling the rotation of auxiliary base 36 is fixed by screw 46 to base 12. Further, screw 46 is inserted into elongated hole 47 of auxiliary base 36 or the auxiliary bracket in the X direction thereof. Thus, the position of stapler 13 in the X direction can be easily adjusted manually. Further, stapler 13 is fixed by screw 48 to auxiliary base 36 and screw 48 is inserted into an elongated hole formed in stapler 13 in the Y direction. The position of stapler 13 can be easily adjusted manually in the Y direction by the unfastening and tightening operations of screw 48. Screws 46 and 48 can be changed to thumbscrews or levers to simplify the operation thereof.

Figure 12:
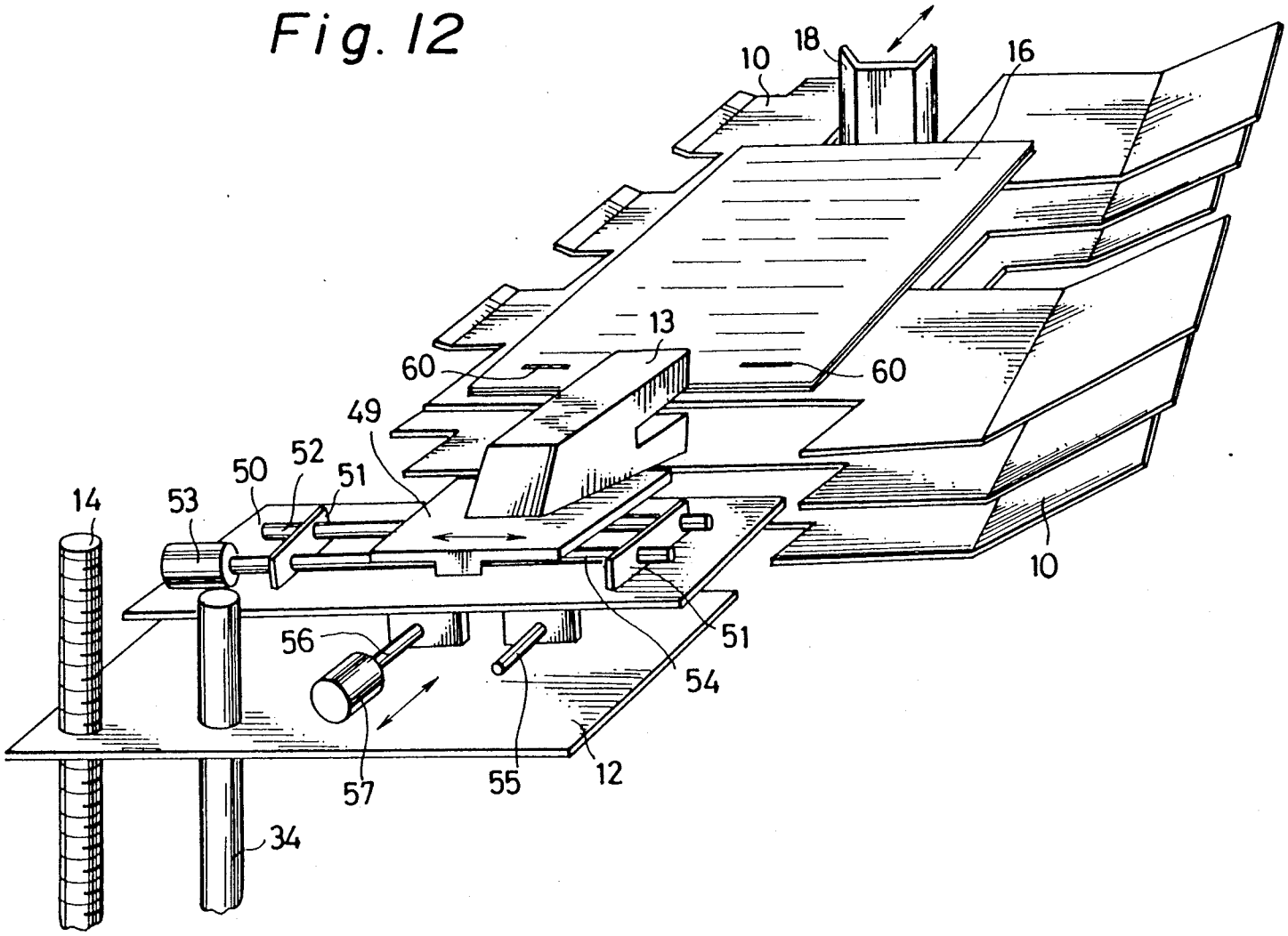
FIG. 12 is a perspective view showing a means for adjusting the automatic position of the stapler.

When the position of the stapler is automatically adjusted, as shown in FIG. 12, bracket 49 for fixing stapler 13 thereto is slid and guided by guide bar 52 in the X direction. Guide bar 52 is fixed and supported by support member 51 fixed to moving base 50, and the position of stapler 13 can be automatically adjusted in the X direction by screwing feed screw 54 rotatably supported by support member 51 and rotated by motor(M3) 53 into moving base 50.

Similarly, moving base 50 is slid and guided in the Y direction by guide rod 55 fixed to base 12 and is screwed into feed screw 56 rotatably supported by base 12 so that moving base 50 is moved in the Y direction when feed screw 56 is rotated by motor(M5) 57, thereby moving stapler 13 in the Y direction.

The position of stapler 13 can be adjusted in the X and Y directions by controlling the rotation of motor(M3) 53 and motor(M5) 57.

By moving stapler 13 in the X direction in this way, the sheets of copying paper 16 can be stapled by double hitting of staple needles 60 along the X direction as shown in FIG. 12. In this embodiment, pressure plate 18 is adapted to move in the Y direction according to the size of copying paper 16 so as to press in the Y direction and properly arrange the sheets of copying paper 16 prior to stapling.

Figure 13:
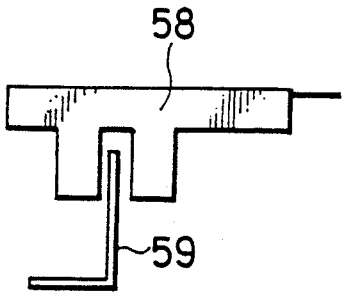
FIG. 13 is a front view showing a position detecting means.
Figure 14:
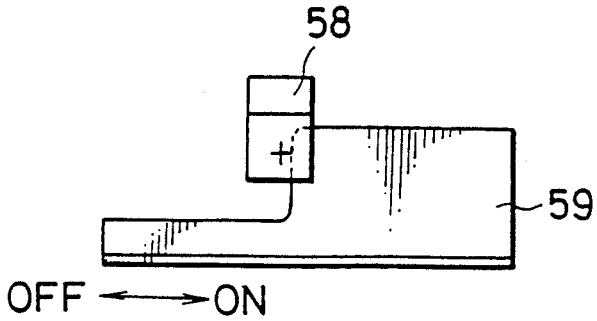
FIG. 14 is a side view of the position detecting means of FIG. 13.
Figure 15:
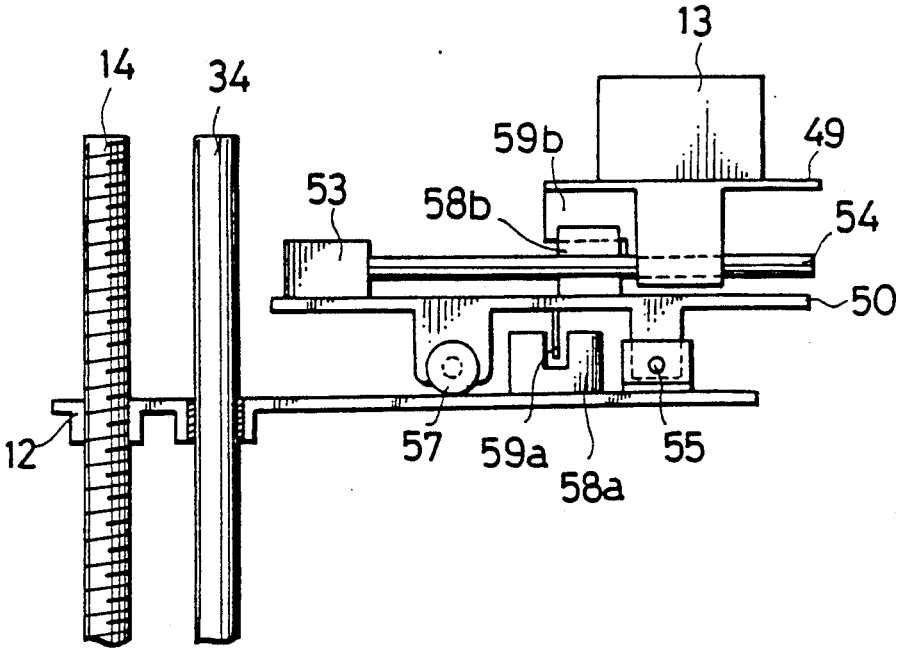
FIG. 15 is a front view showing the arrangement of the position detecting means in FIG. 13.
Figure 16:
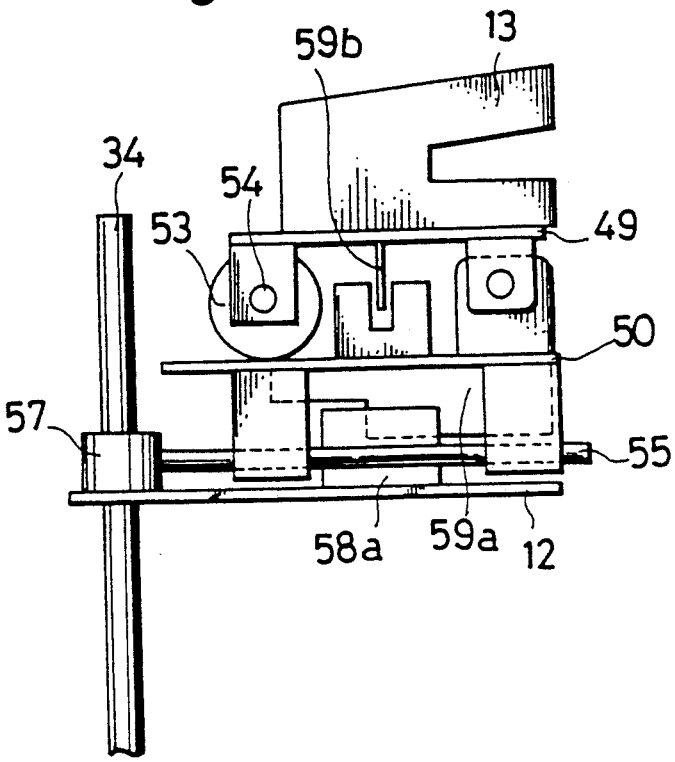
FIG. 16 is a side view of the position detecting means of FIG. 15.

Position-home sensors(S7, S8) are disposed to automatically control the position of stapler 13 in the X and Y directions. Position-home sensors(S7, S8) are constructed by transmission-type photo-interrupter 58 and shield plate 59 for example as shown in FIGS. 13 and 14. Position-home sensors(S7, S8) are arranged as shown in FIGS. 15 and 16 for example. Namely, transmission-type photo-interrupter **58*a* forming position-home sensor(S8) for controlling the operation of the stapler in the Y direction is fixed to base 12 and shield plate 59*a* is fixed to moving base 50. Transmission-type photo-interrupter 58*b* forming position-home sensor(S7) for controlling the operation of the stapler in the X direction is fixed to moving base 50 and shield plate 59*b* is fixed to bracket 49. When shield plate 59 is relatively moved with respect to transmission-type photo-interrupter 58 and shield plate 59 interrupts a light of transmission-type photo-interrupter 58, the corresponding sensor is turned off. When shield plate 59 is separated from transmission-type photo-interrupter 58, the corresponding sensor is turned on. Reference positions of stapler 13** in the X and Y directions are detected by position-home sensors(S7, S8).

In a standard state of the copying machine, e.g., when a main switch of the copying machine is turned on, the operations of motor(M3) 53 and motor(M5) 57 are controlled such that stapler 13 is located in the reference positions.

When a switch for adjusting the position of the stapler arranged in an operating section of the copying machine is pushed, motor(M3) 53 and motor(M5) 57 are driven so that stapler 13 is moved by a designated distance in a designated direction. In this case, the moving distance is controlled by the rotary time or the number of rotations of motor(M3) 53 and motor(M5) 57, etc.

In accordance with the above-mentioned embodiment, stapler 13 can be adjusted with respect to the position and the X and Y directions thereof.

Figure 17:
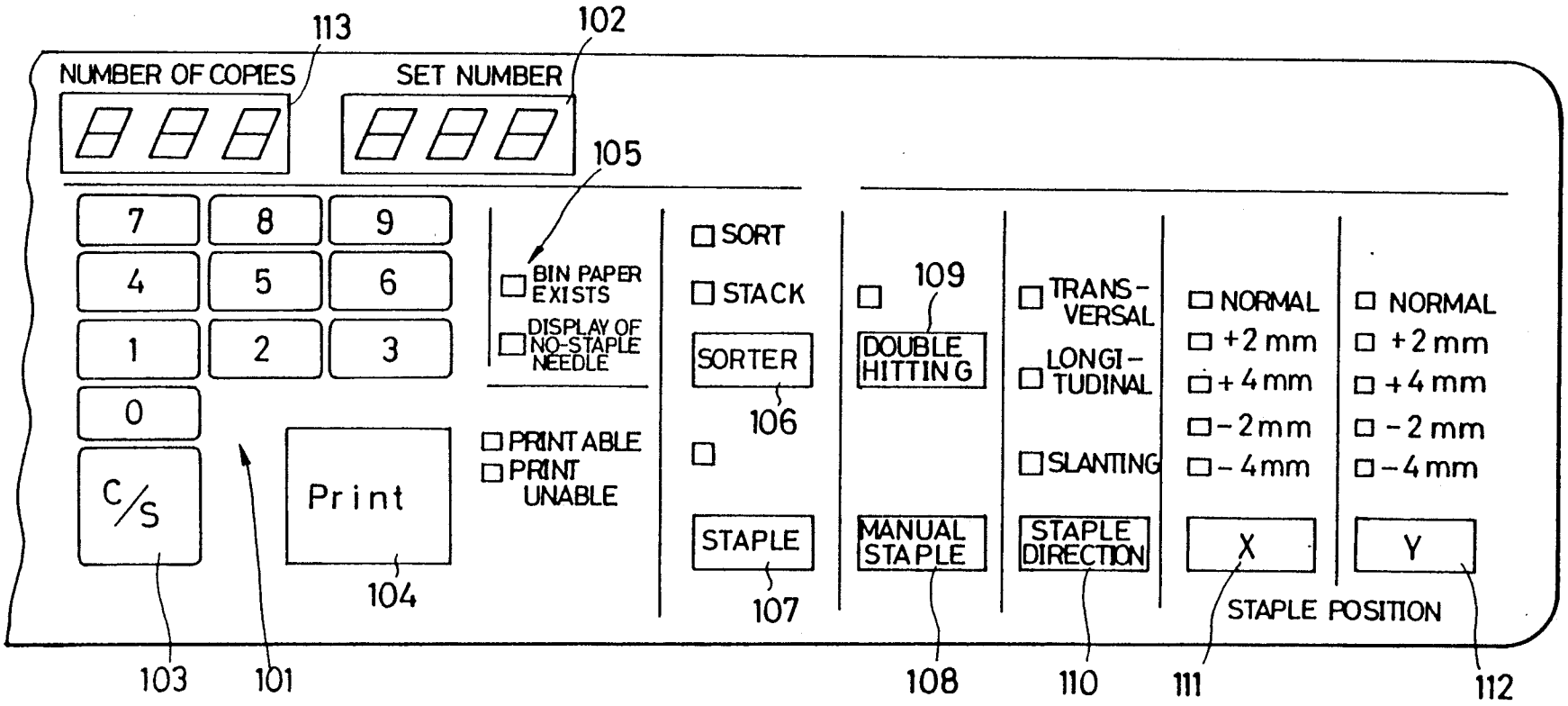
FIG. 17 is a plan view of an operating panel of the copying machine.

The operating panel disposed in copying machine body 2 can be constructed as shown in FIG. 17 for example. In this figure, the operating panel is constructed by a group of key switches, a group of LEDs corresponding to the key switches such that their modes can be confirmed in accordance with the operation of an operator.

Ten key 101 is a key for setting the number of copies, and the set number is displayed on set number display section 102. The real number of copies is displayed on copy number display section 113. C/S key 103 is a key for returning the number of copies to 1 and also has a key function for interrupting the copying operation. Print key 104 is a key for starting the copying operation and is effective when a display for enabling the printing operation is lighted and is ineffective when a display for disabling the printing operation is lighted.

Bin paper existing display 105 is lighted when there is a sheet of paper in a bin of the sorter at the automatically selecting time of a staple mode described later, and simutaneously displays that the printing operation cannot be performed. This is because, since the number of stapled sheets of paper for the stapler is limited (for example, 30 sheets in this embodiment), the stapling operation is inhibited when it is unclear how many sheets of paper are located in the bins.

As is well known, key 106 for selecting a sort mode and an LED display therefor are disposed to select the operation of the sorter.

Staple key 107 for selecting a staple mode is disposed to perform the stapling operation. The sheets of paper copied in the respective bins of the sorter are automatically stapled by stapler 13 after the completion of the copying operation in accordance with the respective stapling conditions on the right-hand side of the operating panel.

When manual key 108 is turned in a state in which the staple mode is selected, the stapling operation can be performed off-line.

Double hitting key 109 is disposed to perform the stapling operation close to bookbinding. In this case, the stapling operation can be performed only when a command for transversally performing the stapling operation is given by staple-direction key 110. The stapling direction can be selected by staple-direction key 110. Namely, the longitudinal, transversal and slanting directions of the stapling operation can be selected with respect to a corner portion of the paper to be stapled. The normal direction of the stapling operation is transversal.

Staple position-X key 111 and staple position-Y key 112 are disposed to adjust the stapling position and the stapling position from an end face of the paper to be stapled can be adjusted in the respective X and Y directions corresponding to the respective double hitting and stapling directions mentioned above.

FIG. **18*a*** schematically shows a control block diagram of the copying machine.

CPU 115 is a well-known microcomputer and is connected to ROM 116, RAM 117 and I/O elements 118 to 122 and performs a sequence control and an operating processing relating to the copying operation by the communication with another control unit 123 such as automatic manuscript feeder(ADF), etc.

Figure 18B:
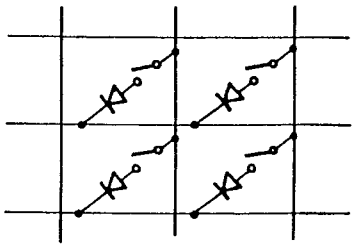
FIGS. 18*a* to 18*c* are respectively an entire control block diagram, a partial view of a key matrix and a partial view of an LED matrix.
Figure 18C:
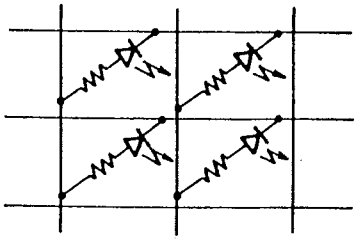
Figure 18A:
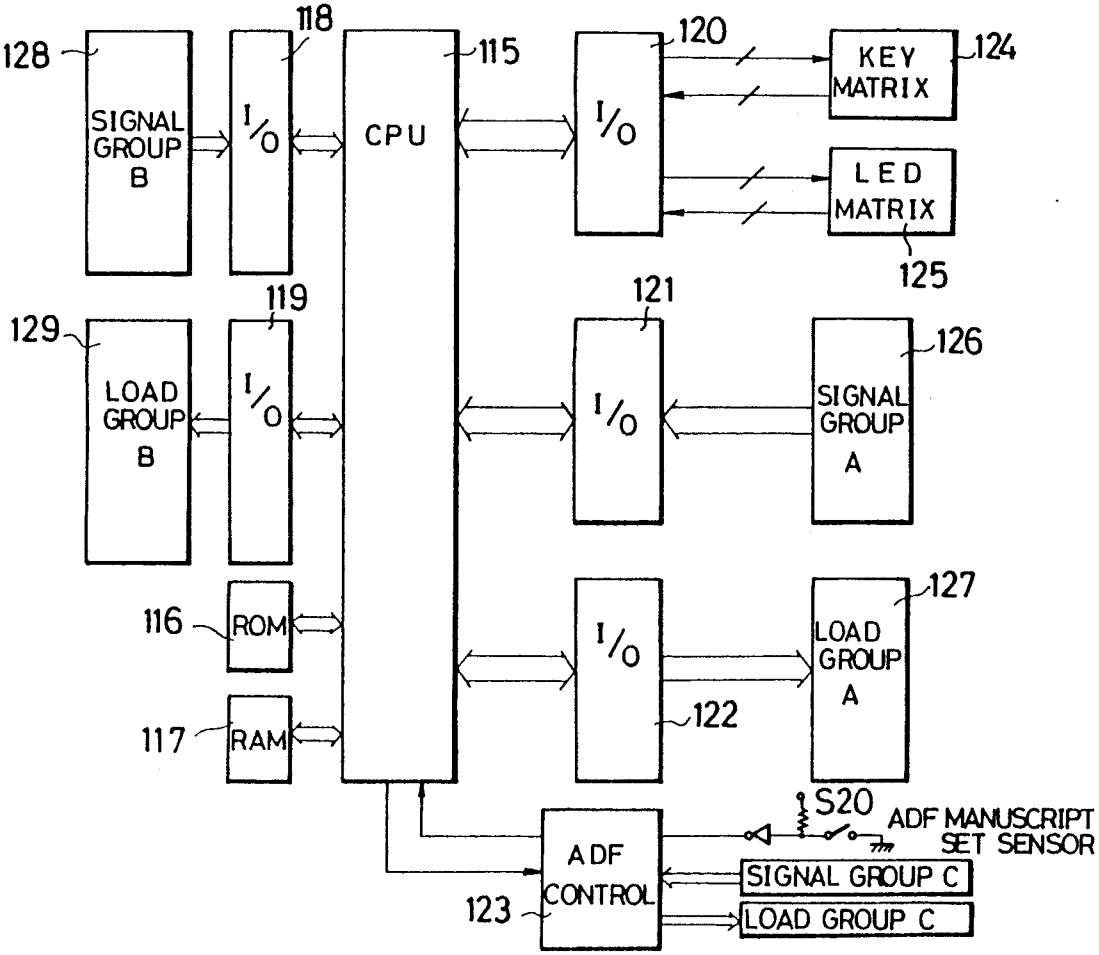

One I/O element 120 is connected to signal lines of a key switch on the above operating panel, well-known key matrix 124 shown in FIG. 18*b* for example and performing an LED display, and LED matrix 125 shown in FIG. 18*c* to perform inputting and outputting processings.

Figure 19:
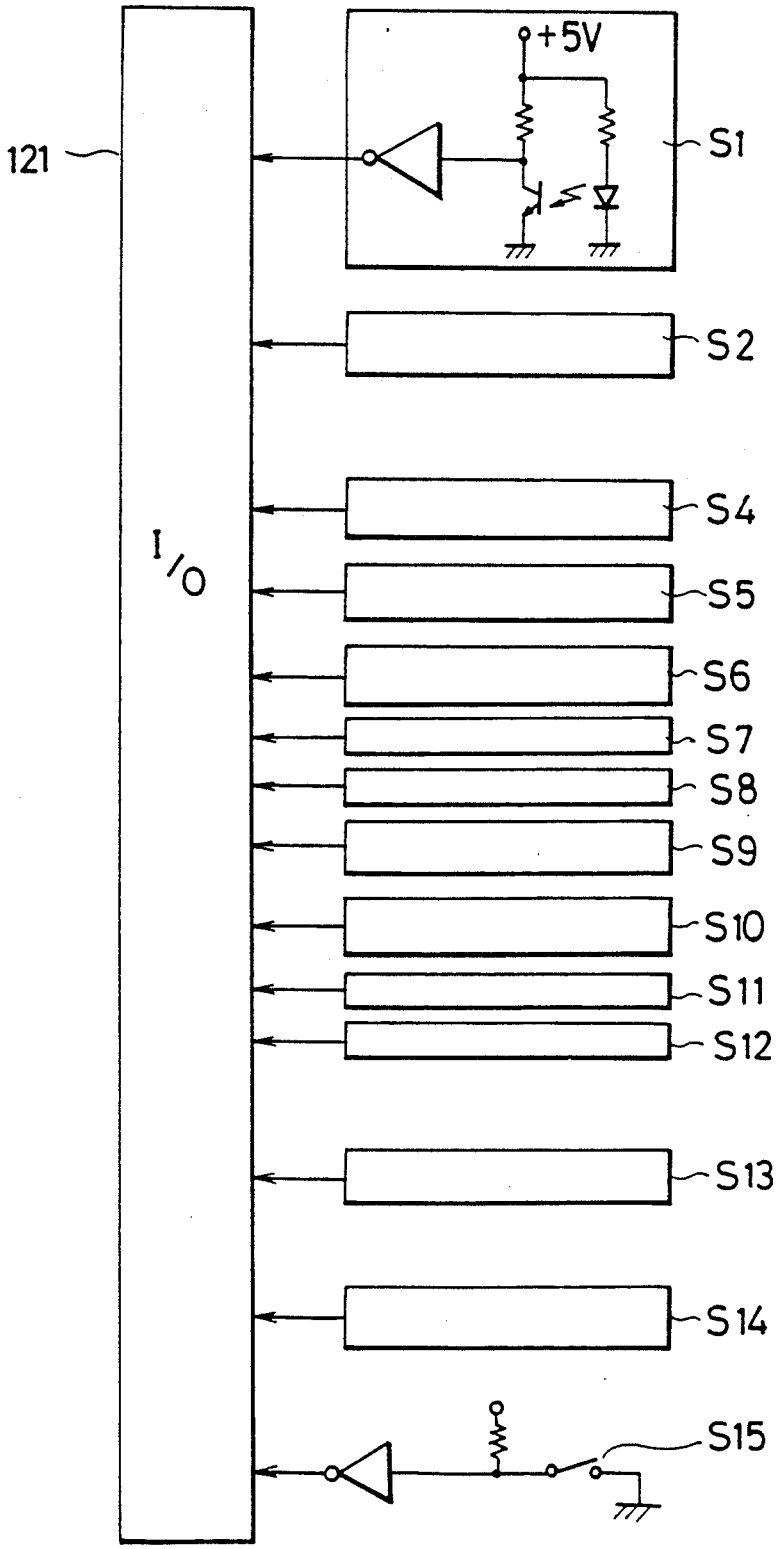
FIG. 19 is a block diagram showing one example of signal group A.
Figure 20:
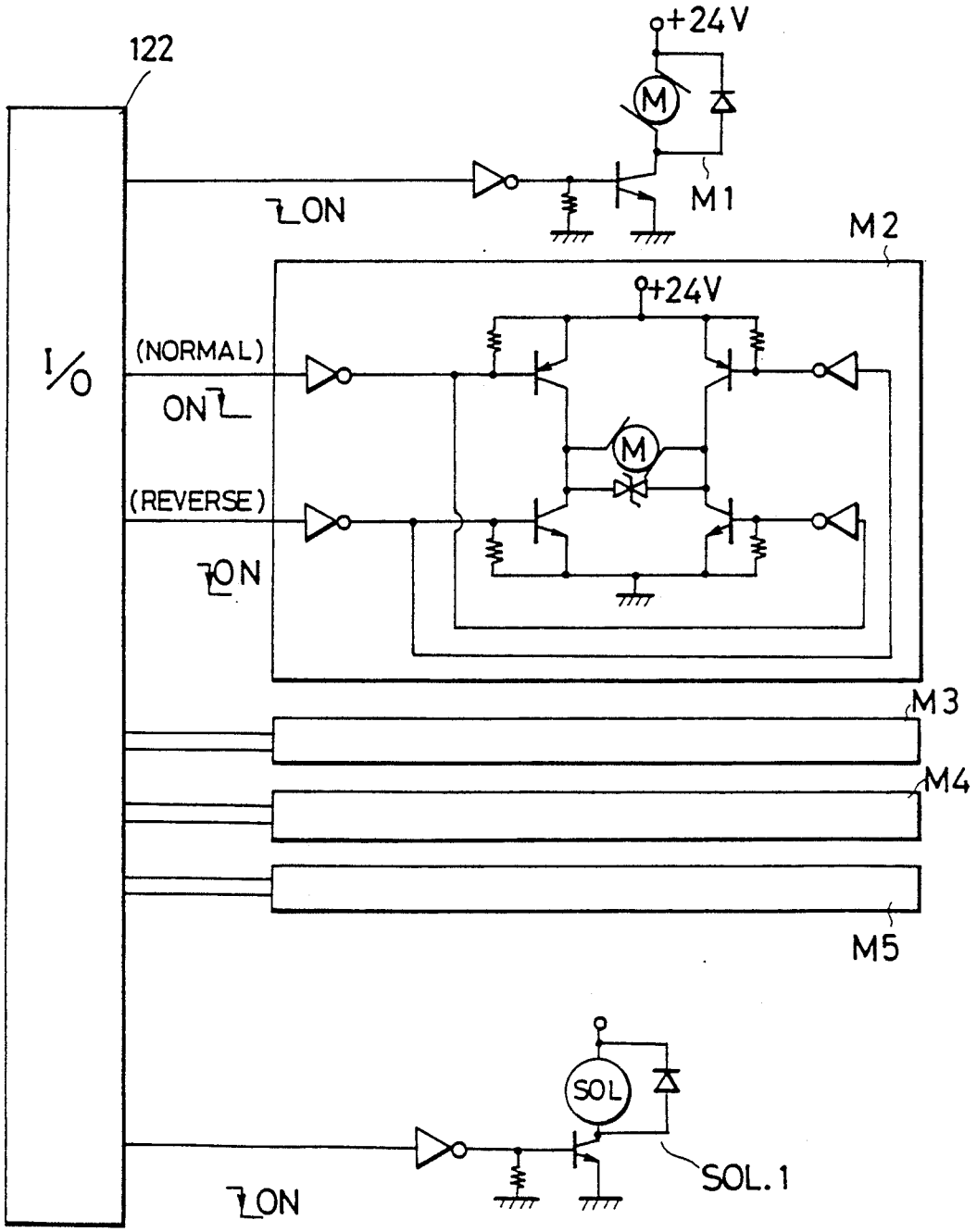
FIG. 20 is a block diagram showing one example of load group A.

Signal group A126 and load group A127 are respectively connected to constructional elements shown in FIGS. 19 and 20, thereby performing the inputting and outputting operations through I/O elements 121 and 122.

Signal group B128 and load group B129 are disposed in the body of the copying machine and therefore the explanation thereof is omitted.

ADF control section 123 is a control section disposed in automatic manuscript feeder(ADF) as is well known and only constructional portions of this control section required to explain the operation thereof in this embodiment are illustrated with respect to control signals of ADF control section 123. In this embodiment, CPU 115 and ADF control section 123 are communicated by a serial communication system.

Signal group A126 is connected to respective constructional portions shown in FIG. 19 for example.

Reference numerals S1 to S14 are photo-sensors each composed of an LED and a photo-transistor to perform various kinds of detections within the sorter.

Switch S15 is a switch for automatically selecting the stapling operation and can be set by an user. In many cases in which the sorted sheets of the copying paper are stapled by stapler 13, the staple mode is automatically set even when the operator forgets to push staple key 107 if this staple automatically selecting switch 15 is turned on and the sorter key are pushed.

Load group A127 is connected to constructional portions shown in FIG. 20 for example.

Reference numerals M1 to M5 are direct current motors. Motor M1 controls the stapler with respect to only a constant rotary direction and motors M2 to M5 controls the stapler with respect to the normal and reverse rotary directions. Reference numeral SOL1 is a solenoid.

The control operation of the copying paper processing apparatus in accordance with the present invention will next be described by the flow charts.

Figure 21:
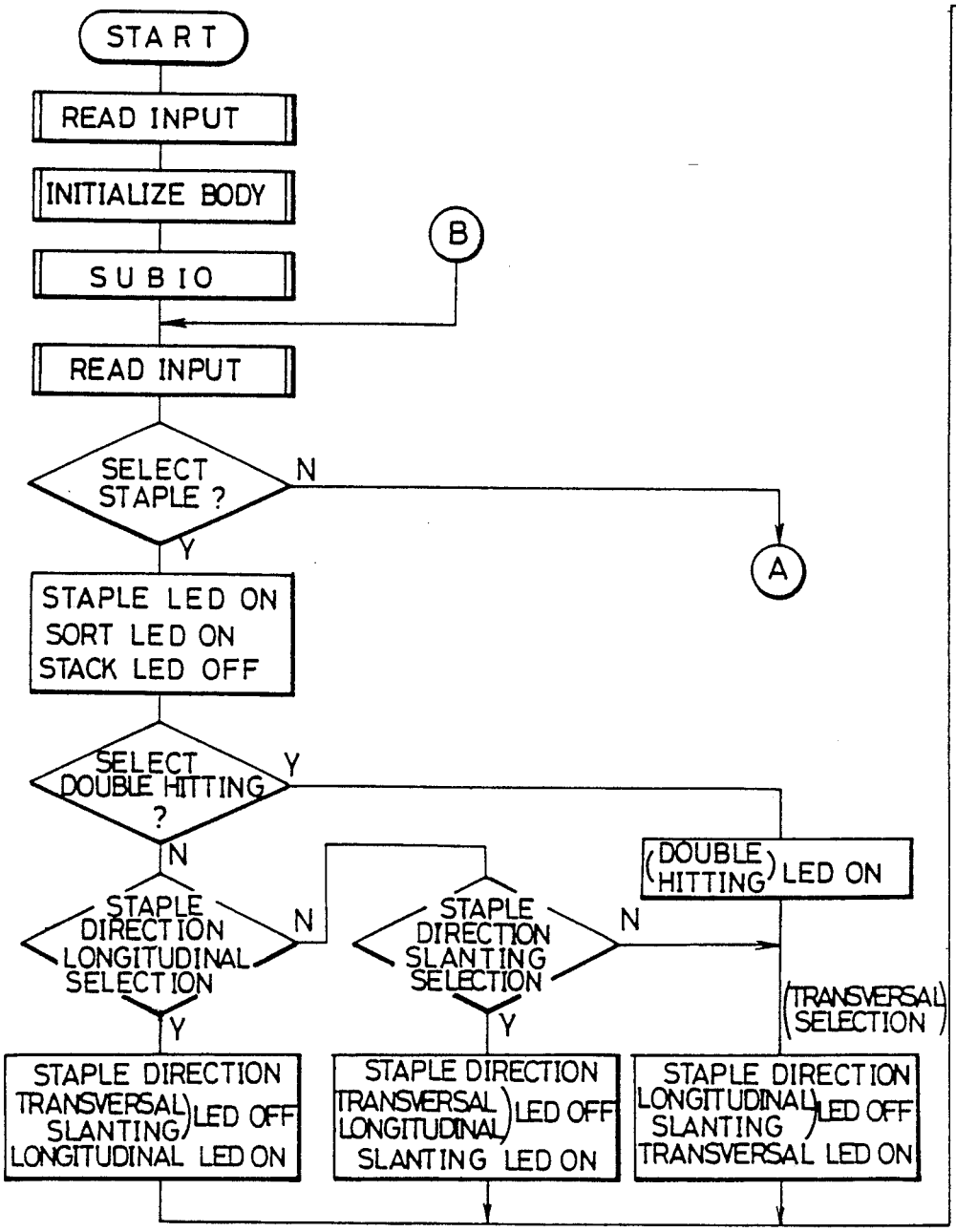
FIGS. 21*i*, 21*ii*, 22*i*, 22*ii*, 23*i*, 23*ii*, 24*i*, 24*ii*, and 25 to 39 are flow charts showing the control operation of the apparatus.

In FIG. 21, when an electric power is applied to the copying machine, first step START begins and subroutine "read input" for reading data composed of various kinds of signal groups is executed. Load group B129 of the body of the copying machine is operated on the basis of these data and is initialized, and display sections, etc. are also initialized.

Figure 25:
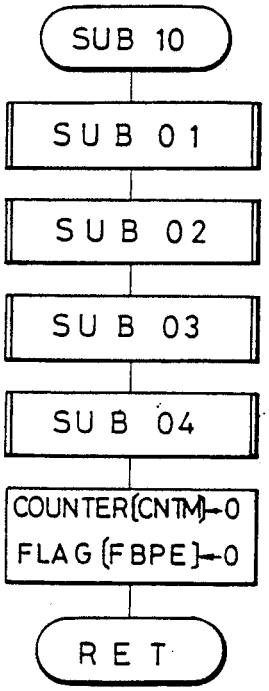
Figure 26:
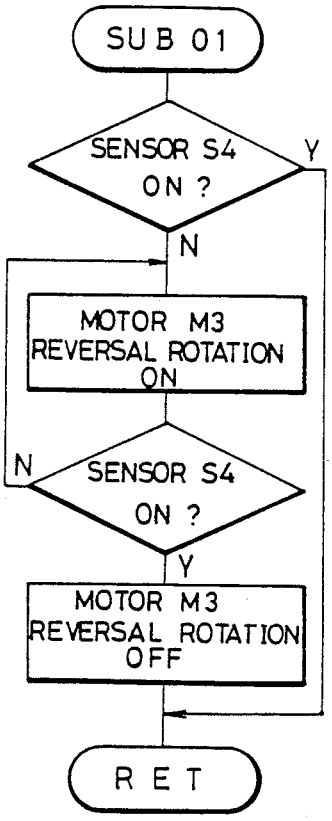
Figure 27:
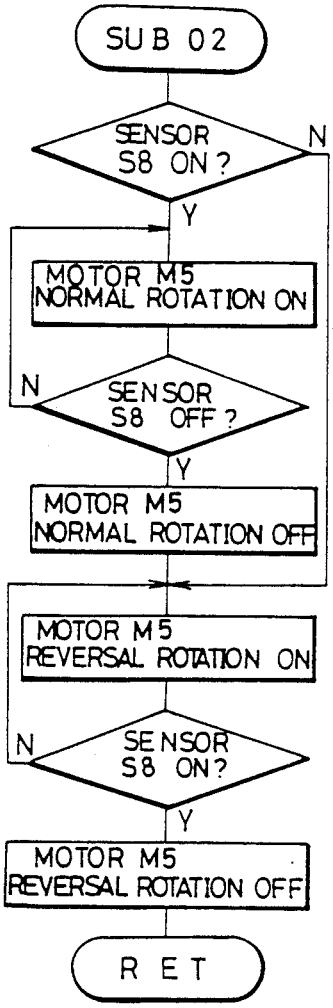
Figure 28:
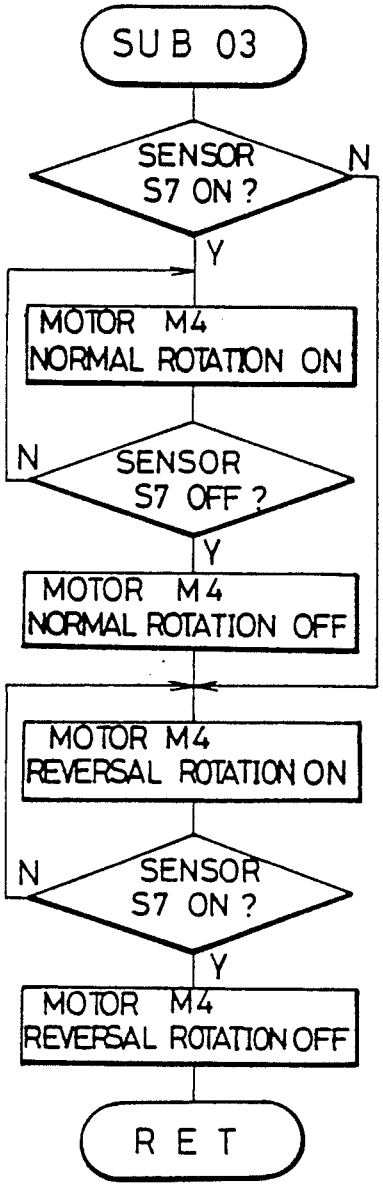
Figure 29:
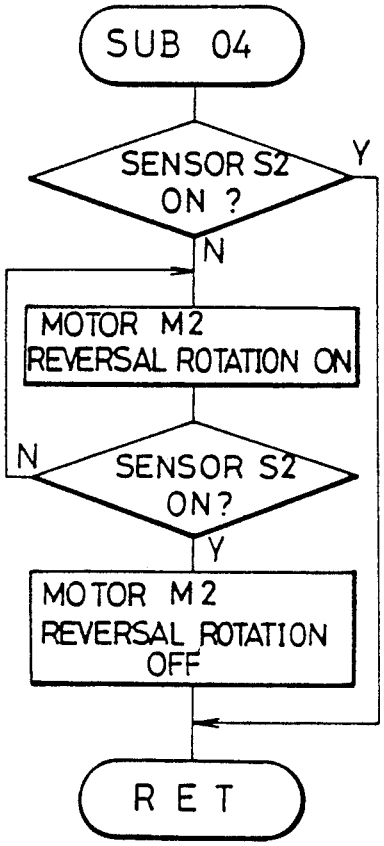

Next, subroutine "SUB 10" is executed and the sorter and the stapling device are initialized. In subroutine "SUB 10", as shown in FIG. 25, subroutines "SUB 01" to "SUB 04" are processed and the respective positions of the stapler are initialized. In subroutine "SUB 01", as shown in FIG. 26, motor(M3) 39 is reversely driven until direction-home sensor(which is also a transversal position sensor)(S4) 41 for setting the stapling direction is turned on. In subroutine "SUB 02", as shown in FIG. 27, a processing for returning the stapling position in the Y direction to a home position is performed and the control for determining the home position is performed by shield plate 59*a* fixed to position-home sensor S8, i.e., moving base 50, and transmission-type photo-interrupter 58*a* fixed to base 12. When position-home sensor S8 is turned on, motor(M5) 57 is rotated in the normal direction and position-home sensor S8 is turned off once. Then, motor(M5) 57 is rotated in the reverse direction. When position-home sensor S8 is turned on, motor(M5) 57 is turned off and thereby the home position is determined.

In subroutine "SUB 03", a processing for returning the stapling position in the X direction to the home position is performed, which is similar to the control processing in subroutine "SUB 02". In this case, motor(M4) 53 and transmission-type photo-interrupter 58*b* for forming position-home sensor S7 are used. In subroutine "SUB 04", a control processing for determining the home position of stapler 13 in the vertical direction thereof is performed. The positioning operation is performed by reversely rotating motor M2 until sensor S2 is turned on. After subroutine "SUB 04", a counter[CNTM] and a flag[FBPE] are reset and thereby the above processings are completed.

Next, subroutine "read input" is executed again and the key input of each staple mode on the above operating panel is checked, thereby setting the mode and the LED display.

When staple key 107 is turned on, the staple mode is selected and the staple LED is turned on. At this time, the sort mode is automatically selected and the sort LED is also turned on, and a stack LED is turned off. Next, when a double hitting mode is selected by double hitting key 109, a double hitting LED is turned on and simultaneously the transversally stapling direction is automatically selected.

In the case of the double hitting mode, it is impossible to structurally perform the stapling operation in the longitudinal and slanting directions so that the transversally stapling operation is automatically performed.

When no double hitting operation is performed, it is checked whether the selected stapling direction is a longitudinal or slanting direction. When the selected stapling direction is the longitudinal direction, a longitudinal LED is turned on, and when the selected stapling direction is the slanting direction, a slanting LED is turned on. When the longitudinal and slanting directions are not selected, the transversal LED is turned on and thereby the transversal mode is set. Namely, the stapling direction when the staple mode is selected is preferentially selected as the transversal direction.

Next, the stapling position, X-key 111, Y-key 112 are described. In this embodiment, as shown in FIG. 10, the normally stapling positions in the X and Y directions are located in a position away by 6 mm from a paper end and can be adjusted at two stages every distance 2 mm in the increasing and decreasing directions. The stapling positions in the X and Y directions are set by X-key 111 and Y-key 112. When X-key 111 is not turned on, a normal LED for displaying the normal position is turned on. When X-key 111 is turned on once, an LED for +2 mm is first turned on and the normal LED is turned off. When X-key 111 is turned on twice, an LED for +2 mm is turned off and an LED for +4 mm is turned on. Similarly, LEDs for −2 and −4 mm are respectively switched at third and fourth times, and, when the LEDs are turned on five times, the normal LED is turned on, thereby returning to the original state.

With respect to Y-key 112, similar to X-key 111, the mode is set and an LED is selected and turned on.

Figure 22I:
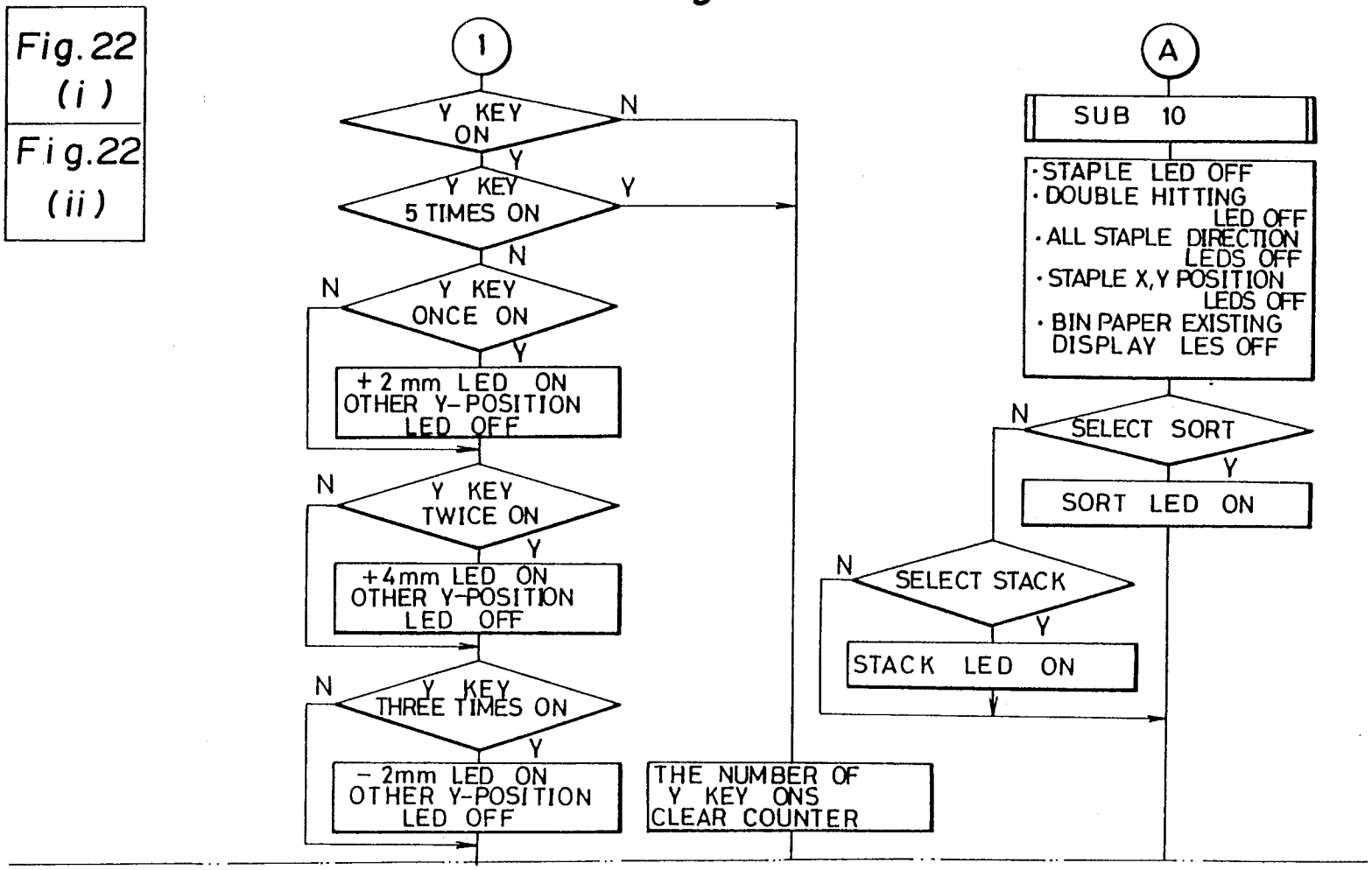

Next, it is checked by staple needle end sensor(S12) 32 whether there is a staple needle or not, as shown in FIG. 22. When there is a staple needle, it proceeds to the next step. When there is no staple needle, a no-stable needle display is lighted and a copy disable flag for disabling the copying operation is turned on.

Next, it is checked whether there is a sheet of paper in the bins of the sorter or not. When there is no paper in the bins of the sorter, a bin paper existing display LED for displaying that there is a sheet of paper in the bins is turned off, and the copy disable flag is also turned off. When there is a sheet of paper in the bins, the copy disable flat is turned on.

The bin paper existing display LED is turned on unless manual staple key 108 is turned on.

When there is a sheet of paper in the bins and manual staple key 108 is turned on, a copy enable flag for enabling the copying operation is turned on and subroutine "STPL 2" of the stapling operation is executed.

Here, since there is no paper in the bins and thereby manual staple key 108 cannot be turned on, the stapling operation can be inhibited when there is no paper in the bins, thereby preventing the stapling operation from performed in error when there is no paper in the bins.

The auto-staple copying operation is inhibited when there is a sheet of paper in the bins, thereby preventing some sheets of paper copied just before and this time from being wrongly combined and stapled and preventing the error in stapling operation by an excessive amount of sheets of paper.

Further, it is possible to perform the stapling operation off-line by making the manual staple key effective in the state in which there is paper in the bins. For example, it is possible to perform the stapling operation by setting a sheet of paper not to be copied to the sorter bins.

Figure 31:
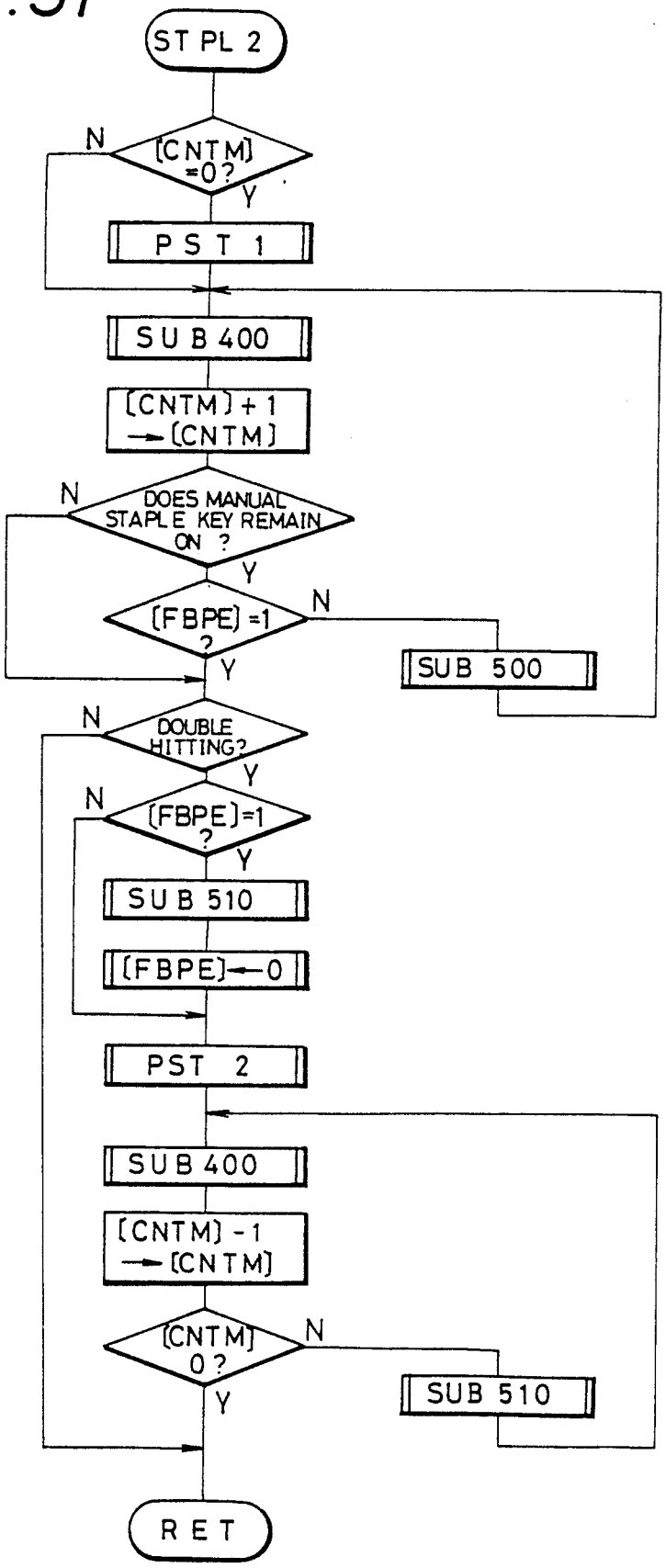

In subroutine "STPL 2", as shown in FIG. 31, a manual staple counter[CNTM] is first checked. When there are no data in this counter, subroutine "PST 1" of positioning operation 1 is executed. When there are data in this counter, no positioning operation is performed. In this counter[CNTM], there are normally no data, but as described later, the manually stapling operation can be performed by both every one staple and continuous staple. When the stapling operation is interrupted every one staple, the positioning operation 1 is set not to be performed when it proceeds to the next processing.

Figure 32:
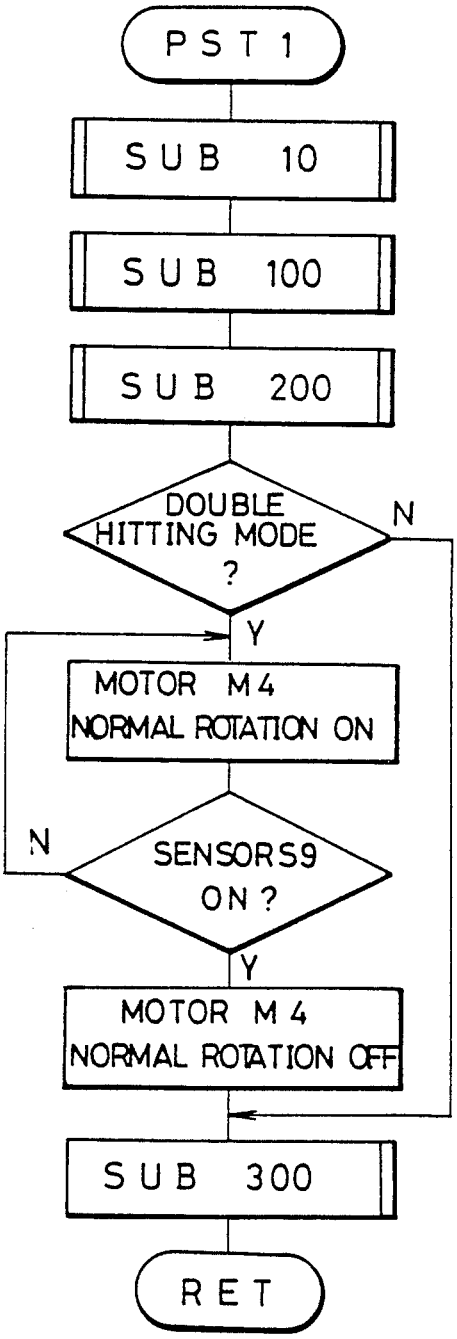

Subroutine "PST 1" of the positioning operation 1 is provided as shown in FIG. 32, and subroutine "SUB 10" is first executed. In subroutine "SUB 10", as described before, the operation for returning the stapler unit to the home position is performed.

Figure 34:
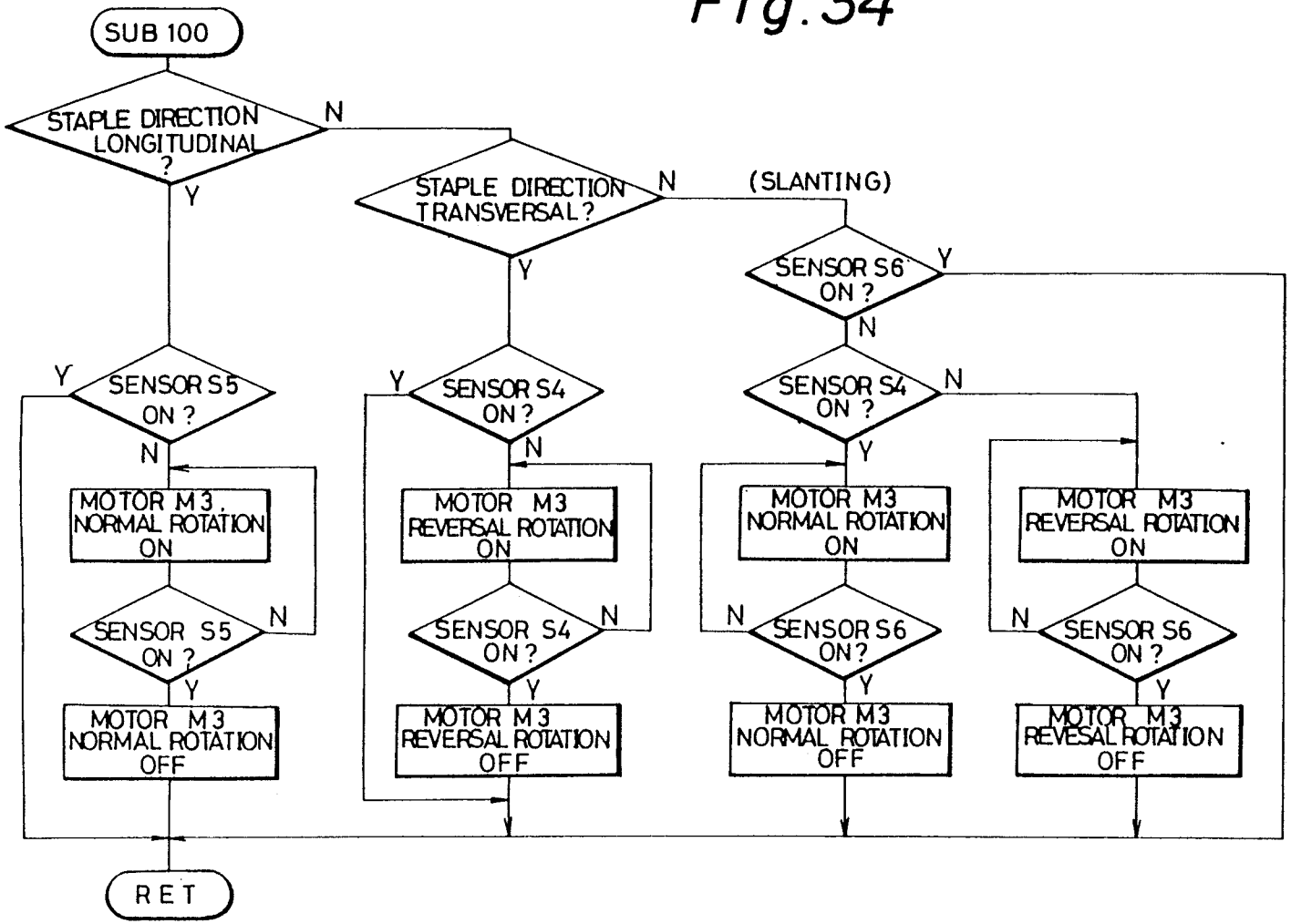

Next, subroutine "SUB 100" is executed. In subroutine "SUB 100", the control of the longitudinal, slanting and transversal positions selected by the mode setting operation in the above-mentioned stapling direction is performed as shown in FIG. 34. When the stapling direction is the longitudinal direction, longitudinal position sensor(S5) 43 is checked. Namely, when this sensor(S5) 45 is not turned on, motor(M3) 39 is rotated in the normal direction. When longitudinal position sensor(S5) 43 is turned on, motor(M5) 39 is turned off.

With respect to the transversal position, motor(M3) 39 is rotated in the reverse direction until transversal position sensor(S4) 41 is turned on. In the case of the slanting position, when slanting position sensor(S6) 42 is not turned on and transversal position sensor(S4) 41 is turned on, motor(M3) 39 is rotated in the normal direction until slanting position sensor(S6) 42 is turned on. In the slanting position, when slanting position sensor(S6) 42 is not turned on and transversal position sensor(S4) 41 is turned off, the position control is performed such that motor(M3) 39 is rotated in the reverse direction and slanting position sensor(S6) 42 is turned on.

Figure 35:
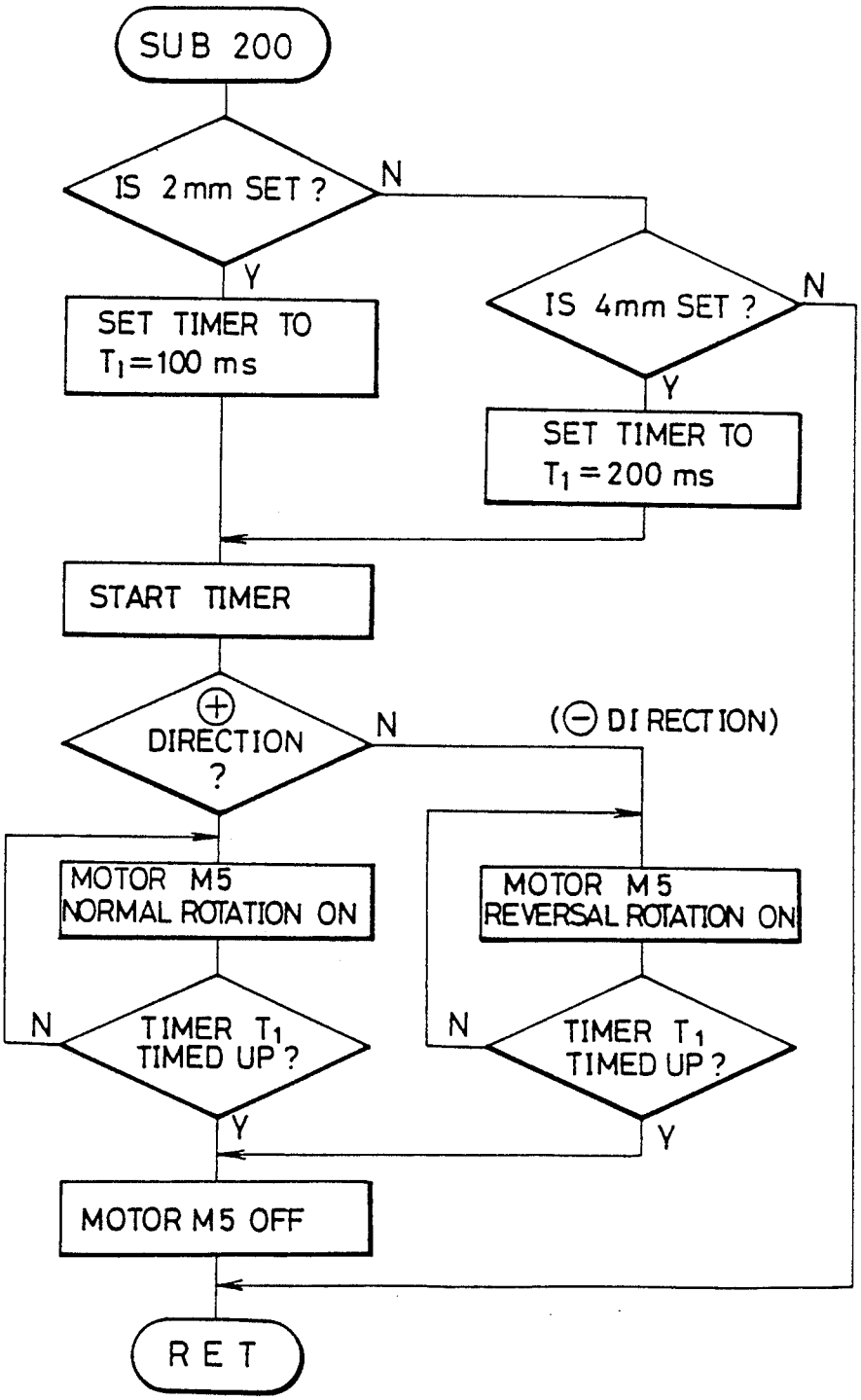

Next, subroutine "SUB 200" is executed. In subroutine "SUB 200", the control for adjusting the position of the stapler in the Y direction is performed as shown in FIG. 35.

In this subroutine, it is first judged whether the setting value of the above position is 2 mm or not. When this setting value is 2 mm, time T1=100 ms is set in timer T1. When the setting value is 4 mm, time T1=200 ms is set in timer T1. When the setting value is not 2 or 4 mm, this routine is completed. After the timer is set and started, it is judged whether it is an increasing⊕ or decreasing⊖ direction with respect to the position of the stapler in the Y direction. In the case of the decreasing⊕ direction, motor(M5) 57 is rotated in the normal direction and is then turned off after the above timer has timed up. Similarly, in the case of the decreasing⊖ direction, motor(M5) 57 is rotated in the reverse direction and is turned off after the timer has timed up. For example, the control of the position of the stapler in Y direction can be performed at speed 20 mm/s by the drive of motor(M5) 57.

Figure 36:
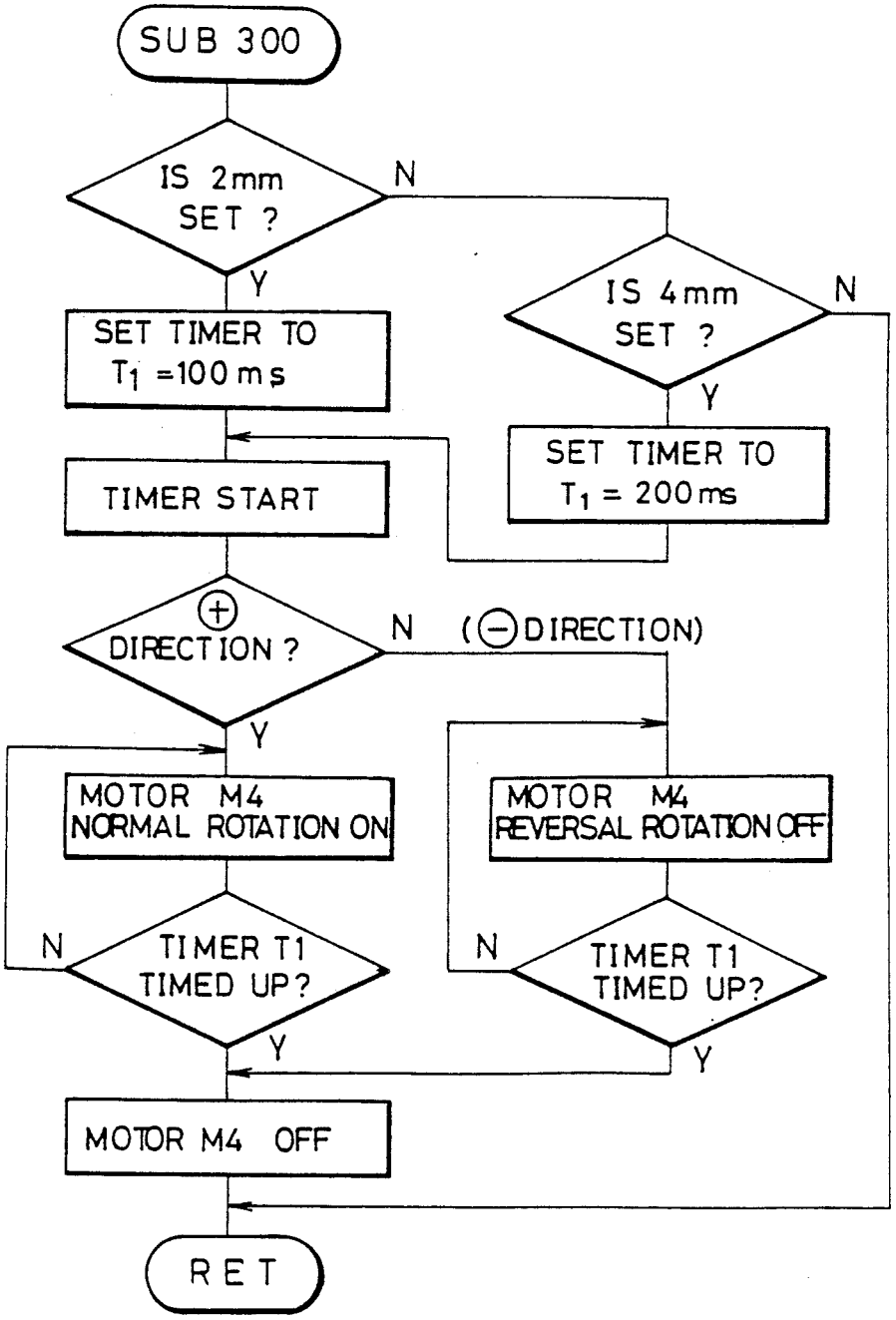

When subroutine "SUB 200" has been completed, it is judged whether it is the double hitting mode or not. When it is not the double hitting mode, subroutine "SUB 300" is executed as shown in FIG. 36.

Subroutine "SUB 300" is almost similar to subroutine "SUB 200". In this routine, the control for adjusting the position of the stapler in the X direction is performed and the positioning operation is performed by the control of motor(M4) 53. In the case of the double hitting mode, after motor(M4) 53 is rotated in the normal direction until the staple unit is moved to a position for turning sensor S9 on, subroutine "SUB 300" is similarly executed and thereafter subroutine "PST 1" is completed.

Figure 37:
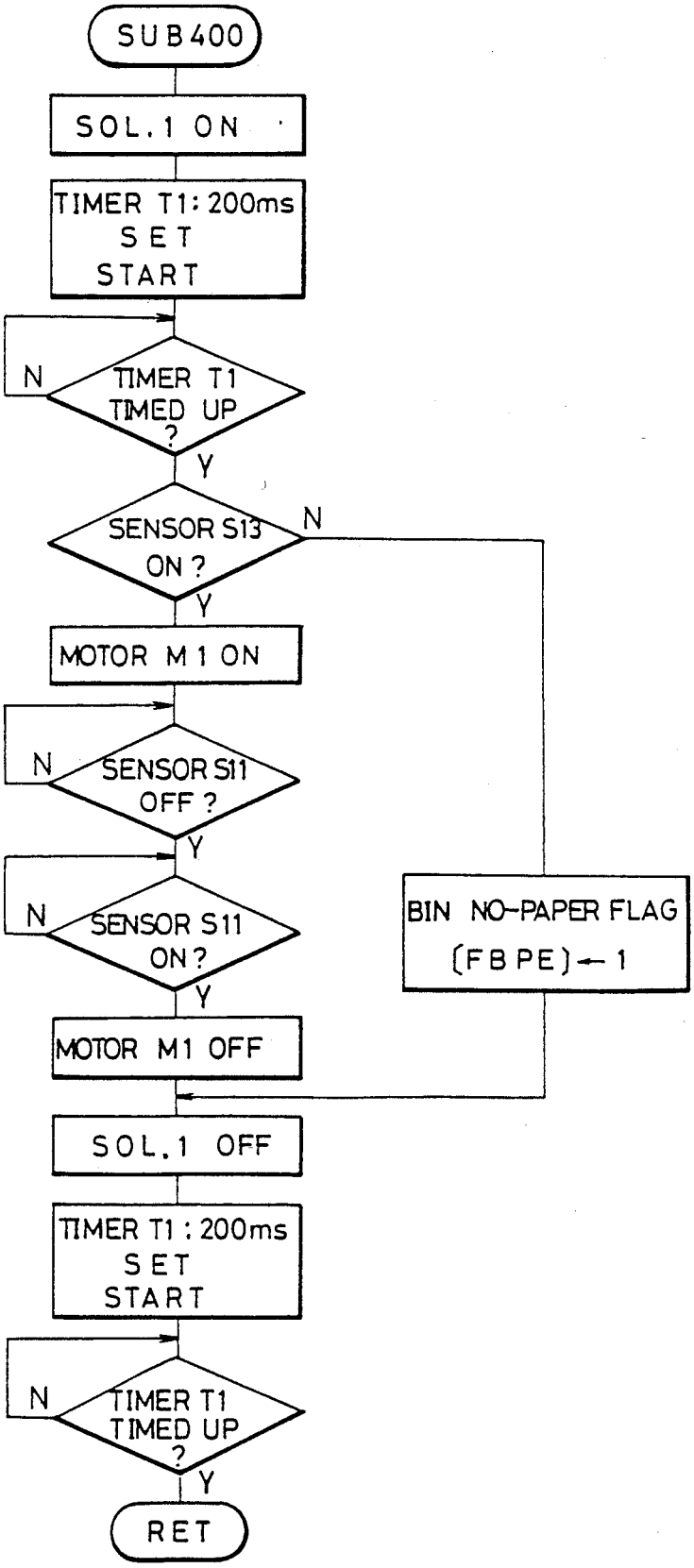

In subroutine "STPL 2" in FIG. 31, when subroutine "PST 1" is executed, the next subroutine "SUB 400" is executed. This subroutine is a routine for moving the bins to the stapling position and performing the stapling operation and returning the bins to the original position. In FIG. 37, solenoid SOL 1 is first turned on. The bins are moved to the stapling position by driving solenoid SOL 1. After solenoid SOL 1 is turned on, timer T1 is set with time T1=200 ms and is then started. When this timer T1 has timed up, stapler paper detecting sensor S13 is checked in operation. This stapler paper detecting sensor is a sensor for checking whether or not there is a sheet of paper on the bins. When the bins are moved and there is no paper in the bins, the next stapling operation is not performed and this subroutine is completed. This construction is made such that it is confirmed that there is no paper on the bins even when it is unclear in which bins there is the paper at the manually stapling time so as to complete the stapling operation. Further, the above construction is also made such that, even at the auto-stapling time, when a sheet of paper is removed from one of the bins for some reasons, no stapling operation with respect to this bin is performed and it can proceed to the processing with respect to the next bin.

In FIG. 3, when stapler paper detecting sensor(S13) 20 is turned off, a bin no-paper flag[FBPE] for showing that there is no paper in the bins is set and solenoid SOL 1 is turned off. When stapler paper detecting sensor(S13) 20 is turned on, motor(M1) 28 for the stapling operation is next turned on. When this motor is turned on, a staple drive unit is operated, thereby hitting a staple needle into the paper. After motor(M1) 28 is turned on, motor(M1) 28 is driven and turned off after stapler drive home sensor S11 is turned off until stapler drive home sensor S11 is turned on again. Next, timer T1 is operated until solenoid SOL 1 is turned off and the bins are returned to the predetermined positions thereof, thereby completing subroutine "SUB 400" in FIG. 37.

When subroutine "SUB 400" has been completed, number 1 is added to manual staple counter[CNTM] and the next processing is performed.

It is next judged whether the manual staple key remains turned on or not.

Figure 38:
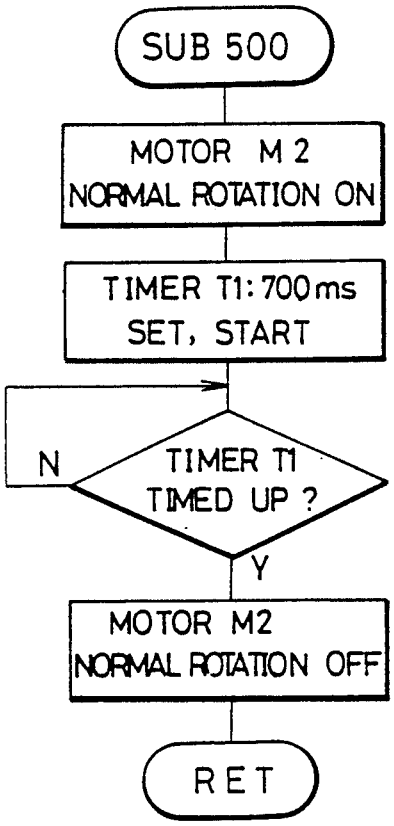

When the manual staple key remains turned on, the above bin no-paper flag[FBPE] for showing that there is no paper in the bins is checked and subroutine "SUB 500" in FIG. 38 is executed unless this flag shows "1".

This construction is made such that the manually stapling operation can be continuously performed when the manual staple key continues to be turned on after the completion of one stapling operation. In other words, the above construction is made such that, when the manual staple key is turned on until the stapling operation with respect to an arbitrary bin, arbitrary sheets of copied paper are stapled and the remaining sheets thereof are not stapled. As shown in FIG. 38, subroutine "SUB 500" is a subroutine for rotating motor M2 in the normal direction for time 700 ms to move the stapler unit to the next bin position. For example, when the distance between the bins is 35 mm, the moving speed of the stapler unit by motor M2 is 50 mm/s. As mentioned above, by subroutine "SUB 500", the stapler unit is moved to the next bin position(downwards) and thereafter it returns to a routine for executing subroutine "SUB 400" again, thereby performing the stapling operation and moving the staple unit repeatedly. Thereafter, the counter[CNTM] continues to perform the counting operation and it proceeds to the next step if the manual staple key is turned off. When the manual staple key remains turned on and flag[FBPE] shows number 1, it proceeds to the next step since there is no paper on the bins.

Figure 39:
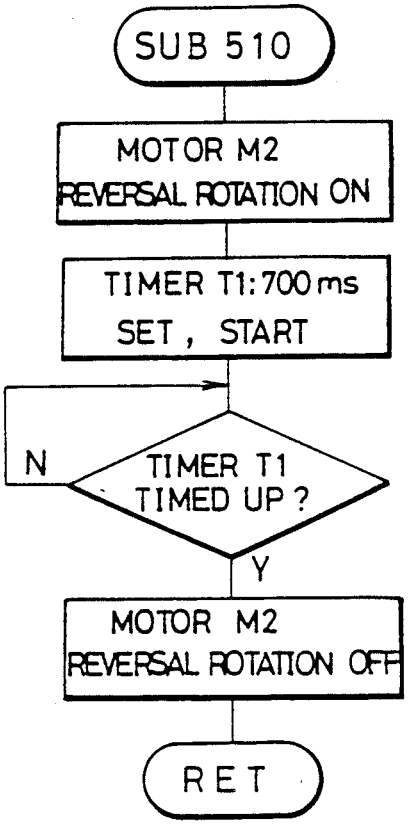

Next, the double hitting mode is checked. When it is not the double hitting mode, subroutine "STPL 2" in FIG. 31 is completed. When it is the double hitting mode, flag[FBPE] is next checked. When flag[FBPE] is equal to one, it is necessary to return the stapler unit to the position of the previous bin(the upward position) since there is no paper in the final bin in one side mode of the above-mentioned double hitting operation, executing subroutine "SUB 510". As shown in FIG. 39, subroutine "SUB 510" is different from subroutine "SUB 500" with respect to only the rotary direction of motor M2 and is a subroutine for moving upwards the stapler unit by an amount of one bin.

After the execution of subroutine "SUB 510", flag[FBPE] is reset and it proceeds to the next step. When flag[FBPE] is equal to zero in the previous judgment of flag[FBPE], it also proceeds to the next step.

Figure 33:
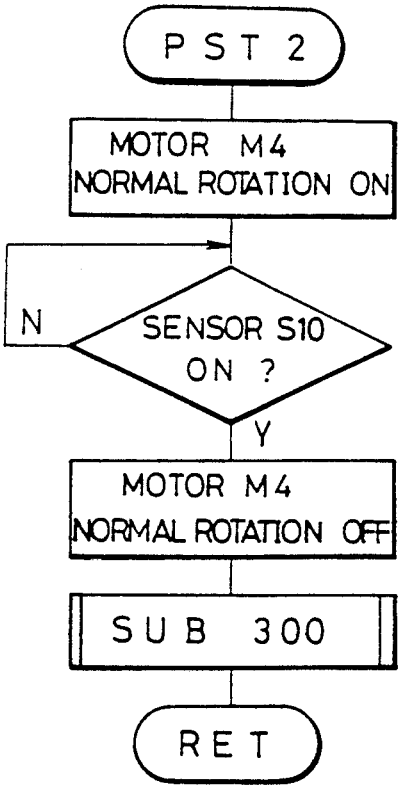

Next, subroutine "PST 2" is executed. As shown in FIG. 33, subroutine "PST 2" is a routine for moving the stapler unit in the X direction and motor(M4) 53 is driven in this routine until sensor S10 is turned on. Sensor S10 constitutes another position reference at the double hitting time. After sensor S10 is turned on, the position of the stapler unit is slightly adjusted in the X direction in subroutine "SUB 300", thereby completing subroutine "PST 2".

Next, subroutine "SUB 400" is executed and the stapling operation is performed. After the stapling operation, the counting value of counter[CNTM] is decreased by one and it is judged whether this counting value is zero or not. When this counting value is not zero, there is paper left in the bins and therefore subroutine "SUB 510" is executed, thereby moving the stapler unit upwards by the one bin amount. Thereafter, subroutine "SUB 400" is repeatedly performed and all the double hitting processings are completed when the counting value of counter[CNTM] is equal to zero, thereby completing subroutine "STPL 2".

In the double hitting operation when manual staple key 108 is not continued to be turned on, the stapler unit is moved in the X direction in the middle of the bins as mentioned above and similarly another stapling operation of the double hitting processing is continued to be performed so that it is possible to perform the double hitting operation with respect to an arbitrary number of copies.

When manual staple key 108 is not continued to be turned on and no double hitting operation is performed, subroutine "STPL 2" is completed once and thereafter it is possible to perform the stapling operation with respect to the next bin. This is because, since the counting value of counter[CNTM] in the first step of subroutine "STPL 2" is not zero, the stapler is not initialized and therefore subroutine "PST 1" is not executed.

When subroutine "STPL 2" is completed, it returns to the main routine and therefore step "read input" is executed again in FIG. 22, thereby setting another copying mode such as a zoom mode and performing processings thereof such as the adjustment of the copying density. The zoom mode and the adjustment of the copying density are not described since they do not relate to the present invention.

In FIG. 2, the description is made with respect to the case in which the stapling selection is checked. When no stapling selection is performed, the routine jumps to mark A and the staple mode is released since it is not the stapling operation as shown in FIG. 22. Namely, subroutine "SUB 10" is first executed and the respective positions of the stapler unit are initialized and thereafter all the LEDs related to the stapler are turned off.

Thereafter, the sorter key is checked. Namely, when it is the sort mode, an LED for the sort mode is turned on, and when it is the stacking operation, a stack LED is turned on. When no selection is performed, these LEDs are not operated and the bin paper existing display is turned off and the copy disable flag is turned off. Then, "read input" in the above-mentioned step is performed and it proceeds to the step for setting the another copy mode and performing the processings thereof.

Thereafter, it is judged how the copied paper is processed. After the copied paper is processed, it proceeds to a copy routine as shown in FIG. 23.

Copy disable flag is first checked. When there is paper in the sorter bins in the staple mode, copy disable flat is set and thereby turned on so that the print disable display is turned on and it returns to mark B. Mark B is shown in FIG. 21 and the input begins to be read again. When there is paper in the sorter bins in the staple mode, this display is continued to be turned on. When the paper is removed from the sorter bins or the staple mode is released, it is possible to perform the printing operation. The copy disable flag is turned on even when another operating condition is satisfied in the above-mentioned input reading operation, e.g., even when the temperature of a fixing heater is not increased to a predetermined temperature, although no detailed description thereof is made.

Figure 23:
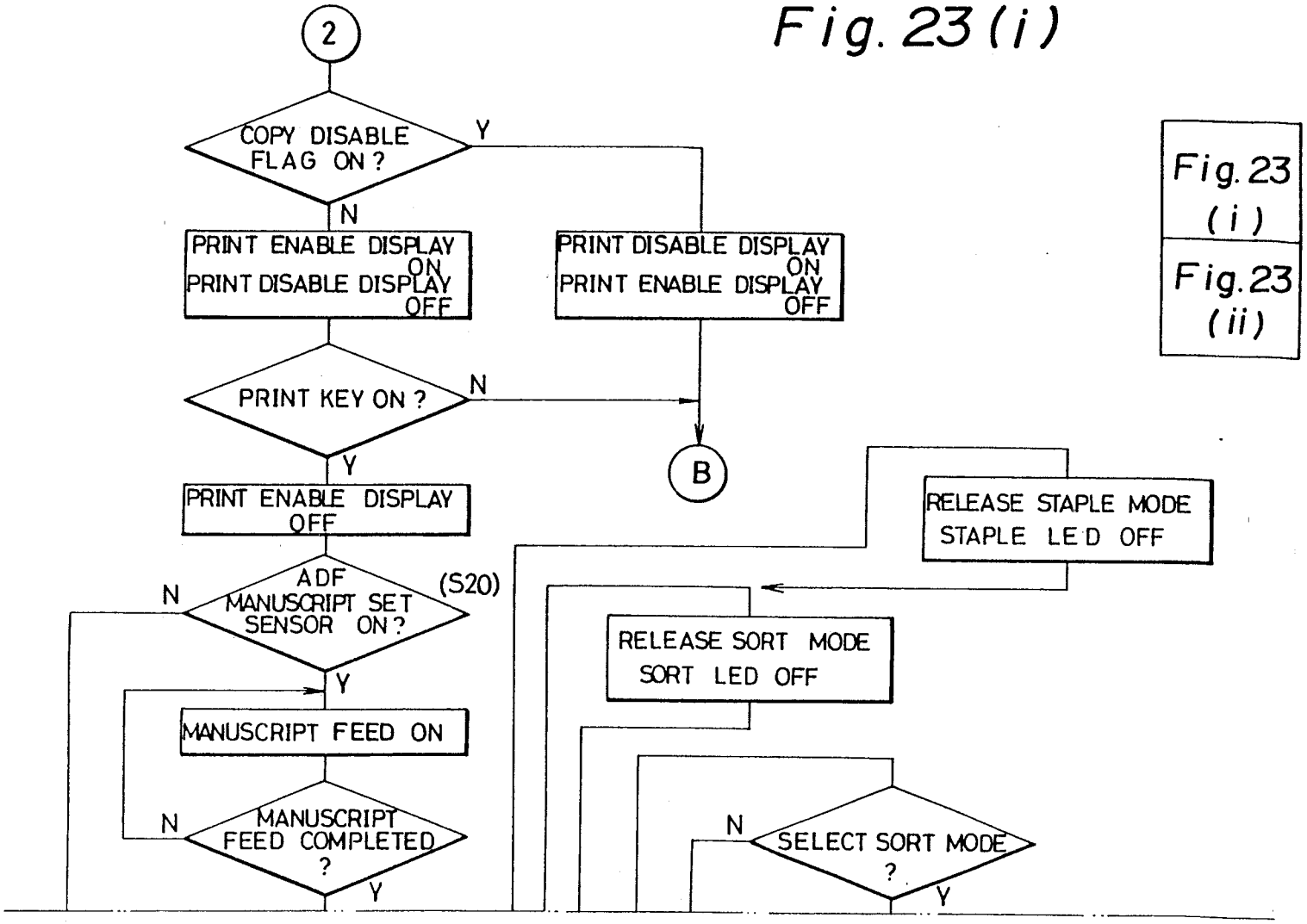

When the copy disable flag is released, the print enable display is turned on and it is judged whether the print key is turned on or not, as shown in FIG. 23. When the print key is not turned on, it returns to mark B.

When print key 104 is turned on, the print enable display is turned off and it proceeds to the copy routine.

It is first judged whether the manuscript is set in the ADF and manuscript set sensor S20 is turned on. When manuscript set sensor S20 is turned off, it does not relate to the ADF and a normal pressure plate mode copy is thereby performed.

When manuscript set sensor S20 is turned on, a manuscript feed signal for allowing the manuscript to be fed is transmitted to the ADF and this sensor awaits until a signal for completing the feeding operation of the manuscript is transmitted from the ADF. When the manuscript feeding operation has been completed, the transmission of the manuscript feed signal is stopped.

Next, it is judged whether ADF manuscript set sensor S20 is turned on or not again. When manuscript set sensor S20 is assumed to be turned off, it is judged that the number of sheets of the manuscript set in the ADF is one. Accordingly, in the next step, if the staple mode is set, the staple mode and the sort mode are released, and if the sort mode is set, the sort mode is released. This means that the stapling and sorting operations are not so useful with respect to only one sheet of the manuscript and therefore are often performed by the error in mode operation such as the copying operation in a mode set by the operator using the copying machine just before, thereby automatically releasing such operations.

When manuscript set sensor S20 is turned on, it is judged that the number of sheets of the manuscript is not less than two so that the above-mentioned stapling and sorting operations are not checked or judged.

The sort mode is next checked again. When it is the sort mode, it is judged whether staple automatic selection switch S15 is turned on or not. Since the sorted sheets of copying paper are often stapled, when this staple automatic selection switch S15 is turned on and the set number of copies[CNTST] is not less than two, the sort mode is released and the staple LED is turned on and the staple transversal direction LED is turned on and the normal positions LEDs for the staple positions X and Y are also turned on.

Namely, the sort mode is switched to a standard state of the staple mode since, when the number of copies is not less than two in the sort mode, the sheets of copied paper are often stapled by a Hotchkiss, etc. and the auto-stapling operation can be performed even when the operator forgets to set the stapler. The staple mode is determined by the desire of the user and therefore switch S15 is disposed to select the staple automatic selection mode by the user.

After the manuscript feeding operation of the ADF has been completed and various kinds of auto-switching operations have been completed, manuscript counter[CNTOL] is cleared once and the counting value thereof is set to one and thereafter it proceeds to the next step.

Figure 24I:
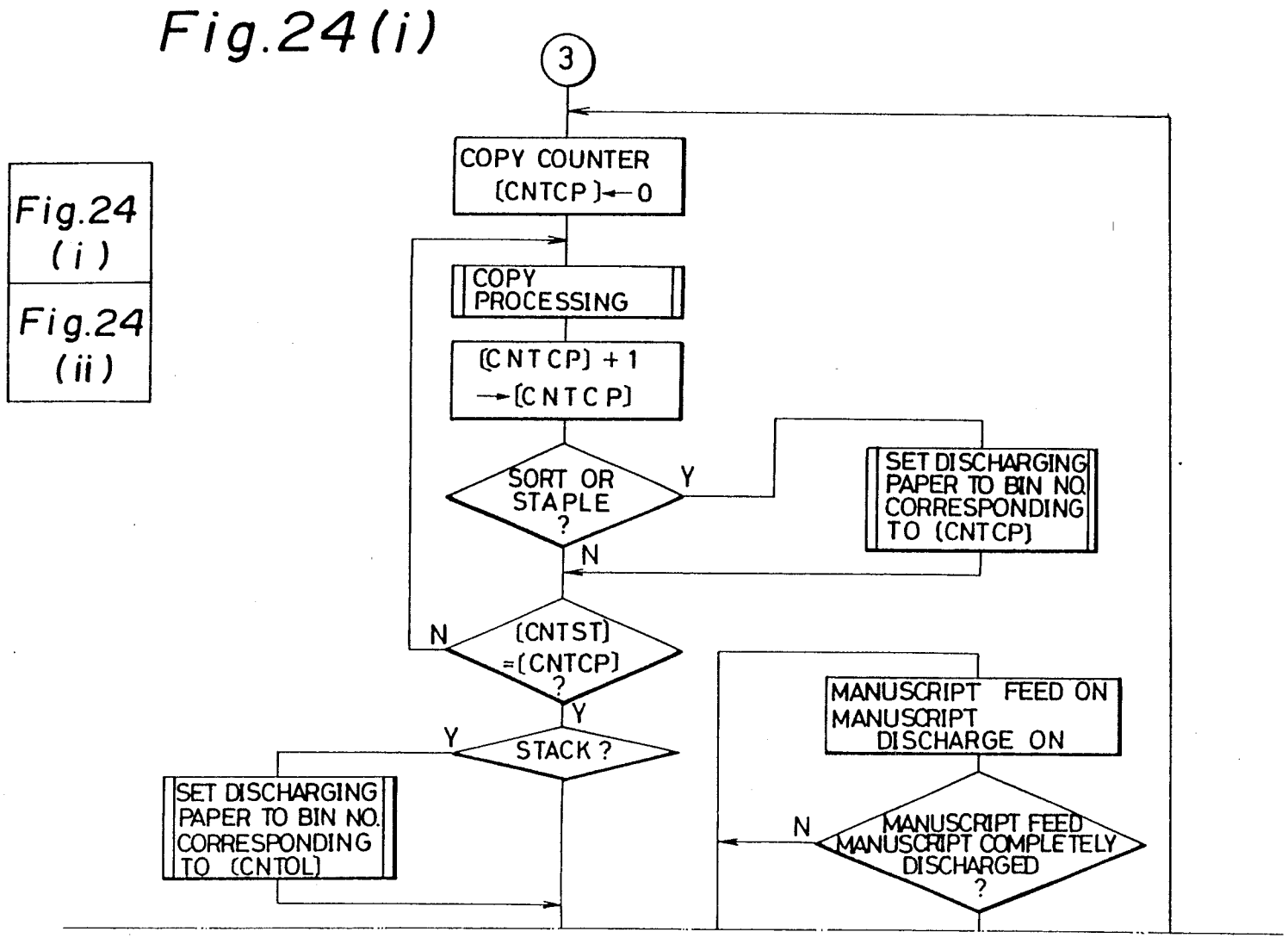

In FIG. 24, copy counter[CNTCP] is cleared. Next, a series of copying processings such as manuscript exposure, development, paper feed, transfer, separation, cleaning, etc. are performed although these processings are not described in detail. Thereafter, the counting value of copy counter[CNTCP] is increased by one. When the sorting or stapling processing is next selected, the paper therefor is discharged to the sorter bin having a number corresponding to copy counter[CNTCP]. When the sorting or stapling processing is not selected, the paper therefor is discharged to the same bin.

Next, when the counting values of set counter[SNTST] and copy counter[CNTCP] are not equal to each other, the copying operation of the manuscript is not completed and therefore the next copying processing is executed until these counting values are equal to each other. When the counting values of set counter[SNTST] and copy counter[CNTCP] are equal to each other and it is the stack mode in the next step, a discharging port for the copying paper with respect to the next manuscript is set in the sorter bin showing the counting value of manuscript counter[CNTOL] added by one.

Next, manuscript set sensor S20 of the ADF is checked. Namely, when manuscript set sensor S20 is turned on, there is the next manuscript so that the manuscript is allowed to be fed and discharged and the manuscript feeding and discharging operations are stopped after the manuscript has been completely fed and discharged. Next, the counting value of manuscript counter[CNTOL] is increased by one. As a result, unless the counting value of manuscript counter[CNTOL] is not less than 31, it returns to the above-mentioned copy routine again and the above-mentioned processings are repeatedly performed.

When the above-mentioned processings have been repeatedly performed and the counting value of manuscript counter[CNTOL] is not less than 31 and the staple mode is selected, the staple mode is released and all the LEDs relating to the stapling operation are turned off. Then, the sort mode is selected and the sort LED is turned on. This is because the stapling ability is limited in the stapling operation and the upper limit of the number of sheets of paper to be copied is set to 30 in this embodiment so that the staple mode is automatically switched to the sort mode when the number of sheets of paper exceeds 30.

When the copying operation is performed and the sheets of the manuscript are fed repeatedly as mentioned above and the ADF manuscript set sensor is thereafter turned off, there is no next manuscript and therefore a copy after-treatment routine is executed. The copy after-treatment routine is a routine for turning off a motor for driving the copying machine, etc., but the detailed description thereof is not made.

Thereafter, it is judged whether it is the staple mode or not. When it is not the staple mode, it returns to mark B to provide the stand-by state for receiving the next copying condition, etc.

Figure 30:
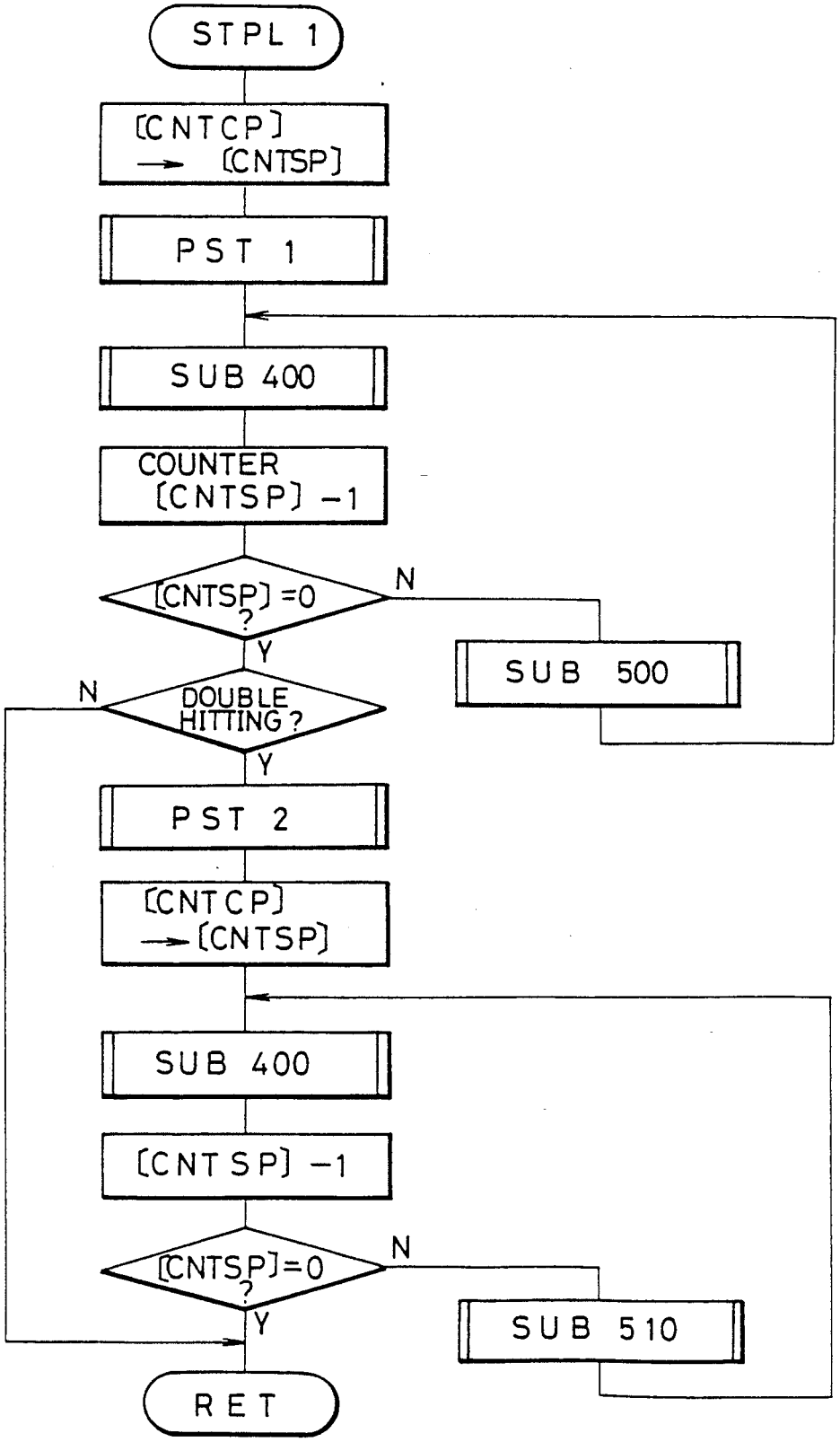

When it is the staple mode, subroutine "STPL 1" for the stapling operation is executed. As shown in FIG. 30, in subroutine "STPL 1", the content of copy counter[CNTCP] is set to staple counter[CNTSP]. Next, subroutine "PST 1" for initializing the stapler is executed.

Thereafter, subroutine "SUB 400" for the stapling operation is executed.

Next, the counting value of counter[CNTSP] is decreased by one and it is judged whether this counting value is equal to zero or not. The content of this counter[CNTSP] is in conformity with that of the above-mentioned copy counter so that the counting value of counter[CNTSP] becomes zero after the stapling operation is performed by the number of copies. When the counting value of counter[CNTSP] is not zero, subroutine "SUB 500" for moving the stapler unit by one bin amount in the downward direction is executed and thereafter the stapling operation is performed repeatedly.

When the counting value of counter[CNTSP] becomes zero, it is judged whether it is the double hitting operation or not. When it is not the double hitting operation, routine "STPL 1" is completed. When it is the double hitting operation, subroutine "PST 2" described before is executed and the stapler unit is moved to one position sensor S10 in the X direction and the position of the stapler unit is slightly adjusted.

Next, after the counting value of copy counter[CNTCP] is set to counter[CNTSP] again, subroutine "SUB 400" for the stapling operation is executed and the counting value of counter[CNTSP] is decreased by one. Thereafter, it is judged whether the counting value of counter[CNTSP] is equal to zero or not. When this counting value is not zero, subroutine "SUB 510" for moving the stapler unit by one bin amount in the upward direction is executed and the stapling operation is performed repeatedly.

When the counting value of counter[CNTSP] becomes zero, subroutine "STPL 1" is completed and it returns to the main routine in FIG. 24. Thereafter, it returns to mark B in FIG. 21 to provide the stand-by state.

Staple needle end sensor(S12) 32 for detecting that there is no staple needle is disposed in stapler 13. The stapler is constructed such that, even when this staple needle end sensor(S12) 32 detects that there is no staple needle, 70 to 100 staple needles or so are still left in the stapler at that time.

As shown in FIG. 22, the staple needle of stapler 13 is checked only when the staple mode is selected. Accordingly, there might be a problem as to whether it is not necessary to check that there is no staple needle during the stapling operation. However, as mentioned above, about 70 to 100 staple needles are left even when the no-staple needle sensor is operated, and the number of sorter bins is set to 20 and 40 staple needles are used even in the double hitting mode in the embodiment of the present invention. Therefore, the stapling operation of the stapler is not interrupted by running out of staple needle during the stapling operation of the copying paper. Accordingly, even when no-staple needle sensor(S12) 32 detects that there is no staple needle during the stapling operation, the stapling operation at that time can be continued and this sensor is checked after the stapling operation has been completely performed with respect to all the sheets of discharged paper and the above-mentioned stand-by state is provided. At this time, no-staple needle is displayed and the next copying operation is inhibited.

Figure 40:
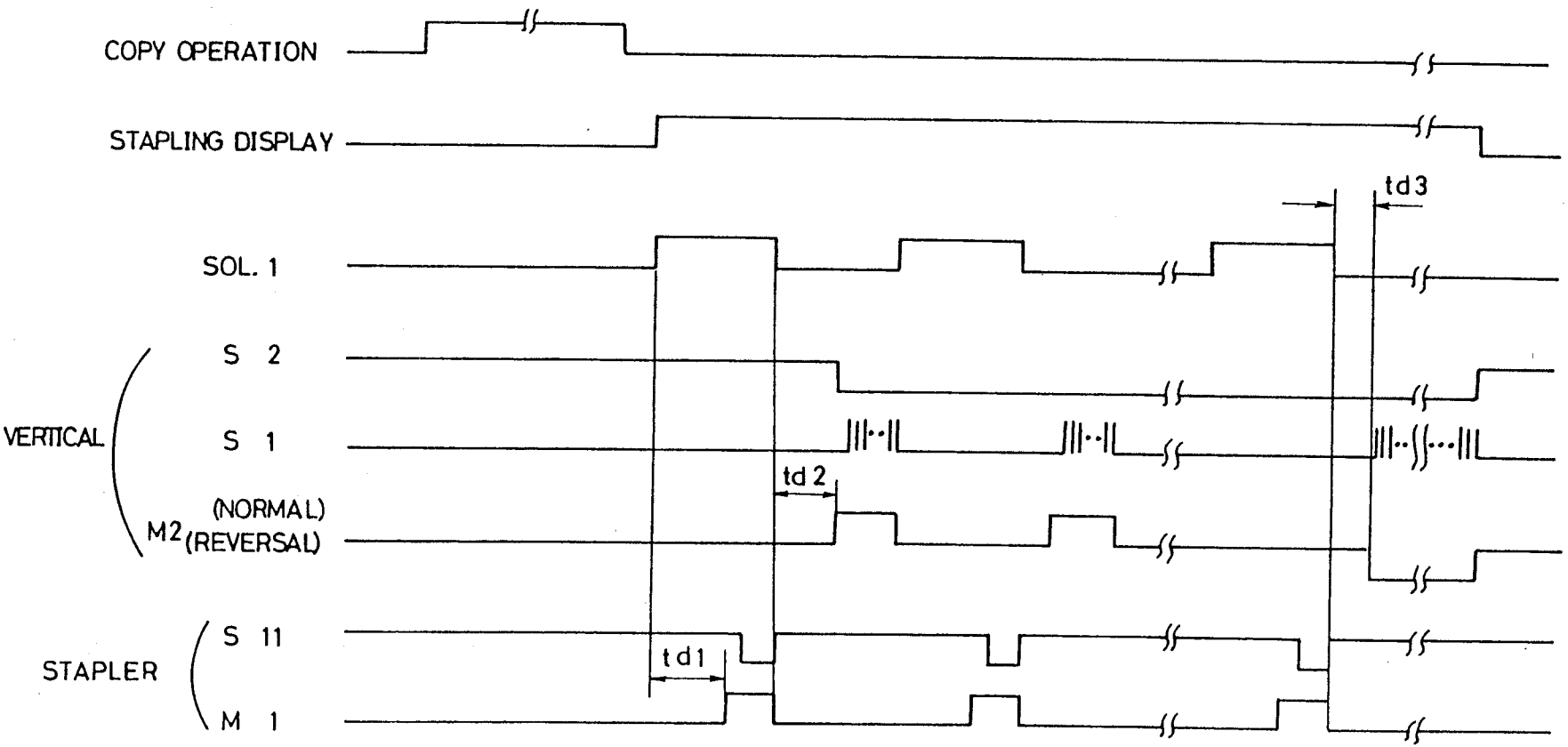
FIGS. 40 and 41 are timing charts of an auto-stapling operation.
Figure 41:
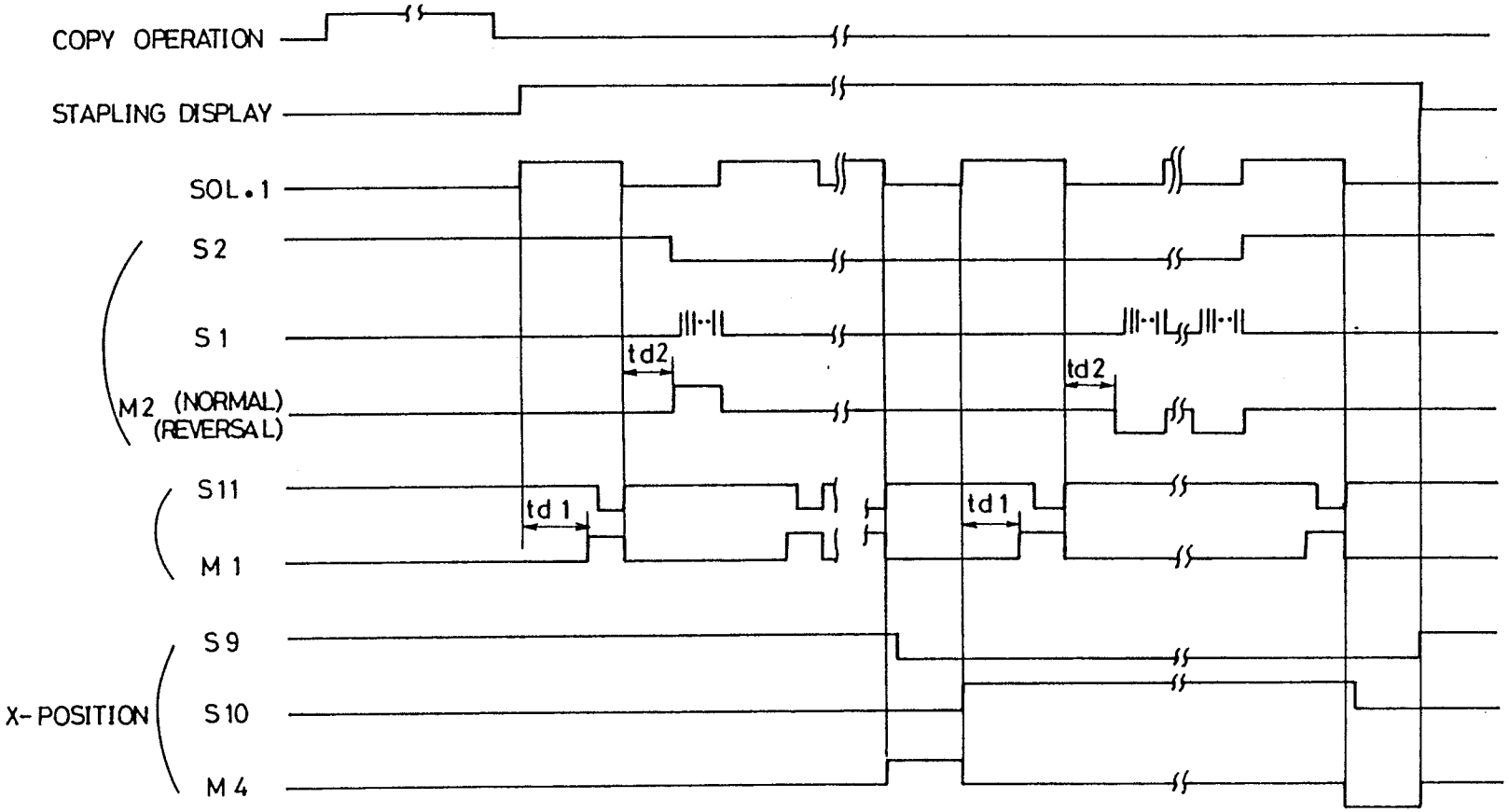

FIGS. 40 and 41 show operating timings of respective constructional portions at the time of the auto-stapling operation. FIG. 40 shows the operating timing of the stapler when one staple needle is hit. FIG. 41 shows the operating timing of the stapler when double staple needles are hit.

As mentioned above, in accordance with the present invention, there is no case in which a plurality of sheets of copying paper are not sorted but are stapled in a overlapping state thereof by the error in operation. Further, there is no case in which the sheets of paper left in the sorter bins just before are stapled in error together with the sheets of paper copied at the present time since the operator forgets to take out these sheets of paper left in the sorter bins just before, etc. Accordingly, the operability of the copying paper processing apparatus is improved and therefore the efficiency in office work is greatly improved.

Further, in accordance with the present invention, in the case in which staple automatic selection switch S15 is turned on to set the staple automatic selection mode, the staple mode is automatically set by setting the sort mode even when the operator forgets to set the staple mode. Therefore, it is not necessary for the operator to perform the stapling operation later so that the efficiency in office work is further improved.

In accordance with the present invention, the stapler is not operated as long as there is no paper on the receiving base of the stapling device. Accordingly, the stapling operation with no staple needle is prevented so that useless consumption of staple needle can be prevented and the respective constructional portions of the apparatus can be prevented from being damaged by the stapling operation with no staple needle.

Further, in accordance with the present invention, there is no case in which the stapler runs out of staple needle during the stapling operation with respect to the plurality of sheets of copying paper. There is no display showing that there is no staple needle during the stapling operation. Accordingly, the stapling operation can be stably performed and the productivity of the apparatus can be improved.

Many widely different embodiments of the present invention may be constructed without departing from the spirit and scope of the present invention. It should be understood that the present invention is not limited to the specific embodiments described in the specification, except as defined in the appended claims.

What is claimed is:

1. A copying paper processing apparatus comprising:

a sorter;

a stapling device for stapling sheets of copying paper sorted by the sorter; and means for automatically selecting and setting a sort mode when a staple mode is selected and set.

2. A copying paper processing apparatus as claimed in claim 1, wherein the stapling device is operated in the staple mode and is not operated in a state in which the sorting operation is not correctly performed.

3. A copying paper processing apparatus as claimed in claim 1, wherein said stapling device includes arranging means for arranging the sheets of the copying paper sorted by the sorter prior to stapling.

4. A copying paper processing apparatus as claimed in claim 3, wherein the arranging means comprises a pressure plate for pressing one side of the sheets of the copying paper along the copying paper so as to arrange the sheets of the copying paper by a predetermined movement according to the size of the copying paper.

5. A copying paper processing apparatus as claimed in claim 4, wherein the arranging means further comprises a stopper for stopping the sheets of the copying paper pressed by the pressure plate at the other side of the sheets of the copying paper so as to arrange the sheets of the copying paper.

6. A copying paper processing apparatus as claimed in claim 1, wherein, even if the staple mode is selected, the setting of the staple mode is inhibited while it is detected that there is already a sheet of paper in bins of the sorter.

7. A copying paper processing apparatus comprising:

a sorter;

a stapling device for stapling sheets of copying paper sorted by the sorter; and means for transmitting a signal indicating that there is no staple needle when the number of staple needles left in the stapling device is a predetermined number greater than the total number of bins of the sorter;

wherein the signal indicating that there is no staple needle is not transmitted even when the number of staple needles left in the stapling device is less than said predetermined number during the operation of the stapling device with respect to the sheets of copying paper sorted by the sorter.

8. A copying paper processing apparatus as claimed in claim 7, wherein all the sheets of copying paper are stapled by the stapling device until the signal indicating that there is no staple needle is transmitted.

9. A copying paper processing apparatus as claimed in claim 7, wherein all the sheets of copying paper in the sorter bins are stapled at least once after the signal indicating that there is no staple needle is transmitted.

* * * * *